US005597284A

United States Patent [19]

Weltlich et al.

[11] Patent Number: 5,597,284

[45] Date of Patent: Jan. 28, 1997

[54] METHOD AND APPARATUS FOR PROCESSING CONTAINER ENDS

[75] Inventors: Kenneth E. Weltlich, Westminster; Howard C. Chasteen, Broomfield, both of Colo.; Michael A. Shuster; Stephen R. Pickenbrock, both of Findlay, Ohio

[73] Assignee: Ball Corporation, Muncie, Ind.

[21] Appl. No.: 569,371

[22] Filed: Dec. 8, 1995

Related U.S. Application Data

[63] Continuation of Ser. No. 232,780, Feb. 25, 1994, abandoned.

[51] Int. Cl.[6] ..... B65G 57/24

[52] U.S. Cl. ..... 414/791.1; 414/798.3; 198/418.6; 198/463.3

[58] Field of Search ..... 414/798.2, 798.3, 414/798.4, 791.1; 198/418.6, 432, 463.3

[56] References Cited

U.S. PATENT DOCUMENTS

| | | | |
|---|---|---|---|
| Re. 26,568 | 4/1969 | Sarovich | 198/41 |
| 2,609,113 | 9/1952 | Huffman . | |
| 2,784,997 | 3/1957 | Baumann | 294/88 |
| 3,056,625 | 10/1962 | Timmerman | 294/106 |
| 3,225,891 | 12/1965 | Hickin et al. | 198/31 |
| 3,272,313 | 9/1966 | Sarovich | 198/41 |
| 3,306,471 | 2/1967 | Devol . | |
| 3,308,977 | 3/1967 | Cochran et al. . | |
| 3,447,663 | 6/1969 | Sarovich | 198/41 |
| 3,453,802 | 7/1969 | Riddington | 53/60 |
| 3,507,380 | 4/1970 | Sarovich et al. | 198/130 |
| 3,687,306 | 8/1972 | Ransom . | |
| 3,881,762 | 5/1975 | Zappia | 294/93 |
| 4,078,654 | 3/1978 | Sarovich | 198/844 |
| 4,136,767 | 1/1979 | Sarovich | 198/689 |
| 4,197,046 | 4/1980 | Shank | 414/110 |
| 4,225,034 | 9/1980 | Sarovich | 198/607 |
| 4,383,795 | 5/1983 | Wakamatsu et al. | 414/753 |
| 4,557,655 | 12/1985 | Berg | 414/32 |
| 4,568,231 | 2/1986 | Czajka et al. | 414/32 |
| 4,611,458 | 9/1986 | Prakken | 53/537 |
| 4,623,057 | 11/1986 | Langenberg | 198/381 |
| 4,808,057 | 2/1989 | Chiappe et al. | 414/267 |
| 4,827,954 | 5/1989 | Layton | 134/76 |
| 4,881,863 | 11/1989 | Braginsky | 414/225 |
| 4,979,870 | 12/1990 | Mojden et al. | 414/788.4 |
| 4,983,095 | 1/1991 | Chiappe et al. | 414/786 |
| 5,016,420 | 5/1991 | Chiappe et al. | 53/138.1 |
| 5,082,519 | 1/1992 | Klose et al. | 156/396 |
| 5,123,796 | 6/1992 | Chiappe et al. | 414/267 |
| 5,133,635 | 7/1992 | Malin et al. | 414/744.8 |
| 5,158,424 | 10/1992 | Mojden et al. | 414/799 |

FOREIGN PATENT DOCUMENTS 1531874 1/1970 Germany .

OTHER PUBLICATIONS

Sardee Industries, Inc.Container Handling Systems, Product Brochure, date unknown.

*Primary Examiner*—Karen B. Merritt
*Assistant Examiner*—Gregory A. Morse
*Attorney, Agent, or Firm*—Sheridan Ross P.C.

[57] ABSTRACT

An assembly is provided for processing container ends received from at least two sources by loading the container ends into trays and stacking the trays. The assembly has a transport device capable of engaging sticks of container ends in a pick-up area and providing the sticks to a plurality of corresponding loading areas such that sticks from different sources are placed in different loading areas. Sticks are provided to the pick-up area by supply subassemblies which receive continuous arrays of container ends from the sources, separate the arrays into sticks, and provide the sticks to the pick-up area. The tray loading subassembly is further capable of engaging and transporting an empty tray from a stack of empty trays to the loading areas such that a stack of trays may be formed. Once the desired stack of trays is formed, a discharge subassembly transports the stack from the loading area to a discharge area for subsequent removal and transport to a desired location.

35 Claims, 23 Drawing Sheets

METHOD AND APPARATUS FOR PROCESSING CONTAINER ENDS

This is a continuation of application Ser. No. 08/232,780, filed on Feb. 25, 1994, now abandoned.

FIELD OF THE INVENTION

The present invention generally relates to the production of containers and, more particularly, to a method and apparatus which enhances one or more aspects of the palletizing of container ends for distribution.

BACKGROUND OF THE INVENTION

In the container-making industry, containers are typically manufactured in at least two parts: a container body and at least one container end. The container body may be drawn and ironed such that only a single container end is required (two-piece container), or the container body may be formed by rolling a stamped sheet into cylindrical form and welding the seam such that two container ends are required (three-piece container). Regardless of the particular container structure, container manufacturers typically separately supply large quantities of container bodies and container ends to customers who introduce substances into the container bodies and subsequently attach the container ends to the container bodies.

In this regard, a predetermined number or "stick" of container ends can be packaged by the manufacturer in face-to-face relation in cylindrical bags having a diameter slightly greater than the container ends for shipment to the customer. A method and apparatus for bagging container ends is disclosed in co-pending, commonly-assigned U.S. patent application Ser. No. 08/023,341.

More recently, container ends have also been supplied to customers as unbagged sticks loaded into reusable trays. The filled trays are typically stacked on top of each other on a pallet, and the pallet is subsequently wrapped in clear plastic wrap to provide a contaminant barrier for the unbagged ends. The stacks of trays are then shipped to customers for use in can filling operations. The use of unbagged sticks of container ends and reusable trays eliminates the process of bagging and unbagging container ends and reduces paper waste (i.e., wasted bags).

The tray loading and palletizing process is generally initiated by receiving a continuous array of container ends from a conversion press via one or more troughs. The ends in each trough are counted and separated into sticks of container ends and each stick is subsequently removed from the trough and inserted into one of a number of appropriately-sized channels in the tray. When a tray is full, the process of loading trays starts again with a new tray. Filled trays are stacked onto a pallet to form a stack of trays, which is subsequently transported (e.g., by a forklift and ground transport) to a can filling station where the ends can be unloaded in a manner similar to, but in the opposite order of, the loading process described above.

Although some devices have been developed which have contributed to the automation of tray loading and palletizing, many of these devices tend to be space-consuming, expensive to operate, and/or unnecessarily complex due to the large number of component parts. In addition, such palletizers typically require the loading of the trays in a loading area separate from the stacking area and/or require a vertically-adjustable platform for iteratively maintaining the top of the stack at a constant height. Furthermore, such devices do not provide a means whereby multiple conversion presses may be serviced by a single apparatus while maintaining container ends from different presses physically separate from each other (e.g., on separate trays and pallets) for quality control purposes. Additionally, such devices typically do not provide a single apparatus which can provide the dual functions of transporting sticks and stacking trays.

Consequently, it is an object of the present invention to provide a reliable, low cost, automated palletizer. It is a related object of the present invention to reduce the number of components parts, to decrease the overall size of an automated palletizer, and to reduce pallet handling. Additionally, it is an object to provide a palletizer which can load sticks directly into a tray while the tray is stacked on other trays and to create a stack of trays without having to iteratively adjust the height of the top of the stack. Furthermore, it is an object of the present invention to provide a single device which can service multiple conversion presses and which can maintain container ends from different presses physically separate from each other.

SUMMARY OF THE INVENTION

Accordingly, the present invention is embodied in an assembly particularly adapted to automatically separate sticks of container ends from arrays of container ends, deposit the sticks into channels of a tray, create a stack of filled trays, and transport the stack of filled trays to a discharge area for subsequent distribution. The assembly generally includes a plurality of operatively interconnected subassemblies, each of which contributes in some respect to automating the process of palletizing container ends to achieve one or more of the above-identified objectives.

The palletizing assembly incorporates a container end supply subassembly which receives multiple arrays of container ends from one or more conversion presses, separates the arrays into sticks, and provides the sticks to a pick-up area for subsequent pick-up by a tray loading subassembly (e.g., a transport device). The supply subassembly generally comprises a separator for separating sticks from the incoming arrays in a separating area and for providing the sticks to a staging area. A shuttle is provided for temporary holding of the stick in the staging area and for transporting the stick to the pick-up area in preparation for pick-up. Preferably, a trough (e.g., U-shaped) is utilized for facilitating transport of the sticks from the separating area to the pick-up area. More preferably, the trough is inclined (e.g., about 20 degrees) such that the container ends on the downstream end of each stick do not fall over during transport and pick-up thereof. Alternatively, instead of being inclined, the trough may comprise resilient rails (e.g., rubber) which engage the perimeter of the container ends to prevent the container ends from falling over during separation and transport.

In one aspect of the invention, the supply subassembly comprises sensors for monitoring the status of incoming sticks of container ends. Such sensors may, for example, include one or more separating sensors for sensing the presence of a stick in the separating area where container ends forming the array are counted and separated into sticks. One or more staging sensors may be utilized for sensing the presence of a stick in the corresponding downstream staging area between the separating area and the pick-up area. Further, one or more pick-up sensors may be utilized for sensing the presence of a stick in the corresponding downstream pick-up area where the sticks are positioned for engagement by the tray loading subassembly, as described below in more detail. Each of the sensors may be operatively connected to a control means which utilizes signals from the sensors to selectively activate/deactivate the upstream conversion press under certain conditions. For example, if the sensors indicate that a stick of container ends is present in each of the respective areas, the control means will deactivate the upstream conversion press to prevent the arrays of container ends from running into previously-separated sticks of container ends.

In another aspect of the invention, the palletizing assembly includes a tray loading subassembly capable of simultaneously servicing two conversion presses. The tray-loading subassembly preferably includes a single transport device for transporting sticks of container ends from one or more pick-up areas and depositing them into first and second loading areas in a known relationship. More specifically, the transport device is programmed to only deposit sticks from a particular conversion presses into a particular loading area (e.g., into certain tray channels) such that sticks at a particular loading area (e.g., within particular channels, such as the odd-numbered channels) will have only been produced on a particular conversion press. Such physical separation of sticks of container ends from different presses allows for subsequent identification of the press upon which a particular stick of container ends was produced, which can provide valuable quality control information.

In one embodiment, the tray loading subassembly may comprise two separate pick-up areas (e.g., a first pick-up area for receiving container ends from the first conversion press and a second pick-up area for receiving container ends from the second conversion press, with the transport device positioned therebetween). The first and second loading areas may have separate trays such that container ends from separate conversion presses are loaded into separate trays. Similar to above-described embodiment, a single transport device is programmed to only deposit sticks from a particular conversion presses (i.e., from a particular pick-up area) into the appropriate tray (i.e., at the corresponding loading area). As such, container ends from different conversion presses will be maintained in separate trays to further facilitate identification of the conversion press upon which particular container ends were produced.

The transport device of the tray loading subassembly may comprise a pick-up head for selectively engaging and disengaging at least one stick of container ends. The transport device selectively moves the pick-up head between the pick-up area(s) and the respective loading areas to load sticks into the tray channels. The pick-up head may comprise at least one inflatable bladder selectively movable between expanded and collapsed conditions, such that the pick-up head will engage at least one stick of appropriate-positioned container ends when the bladder is expanded and the pick-up head will disengage a stick of engaged container ends when the bladder is collapsed. Preferably, the bladder comprises at least two parallel bladder portions positioned in spaced relation to each other such that a distance between the bladder portions is less than a diameter of a stick when the bladder is expanded, and such that the distance between the bladder portions is greater than the diameter of a stick when the bladder is collapsed. More preferably, the bladder comprises four parallel bladder portions for engaging three sticks of container ends.

The pick-up head may further comprise axial compression means for selectively providing axial compression to opposing ends of the engaged sticks. Preferably, such axial compression means comprises at least two compression clamps mounted on opposing end portions of the pick-up head and movable between a compressed condition and a released condition. More preferably, such axial compression means comprises six independently-movable compression members appropriately mounted on opposing end portions of the pick-up head to provide effective axial compression to three sticks of container ends even though the lengths of the sticks may vary from one another.

The pick-up head may be further provided with an engaging means for selectively engaging and disengaging an empty tray, such that an empty tray may be engaged from a stack of empty trays (e.g., at a tray supply area), moved to one of the loading areas, and deposited in stacked relation over a full tray at the corresponding loading area. Preferably, the engaging means comprises at least two tray lift members mounted on opposing portions of the pick-up head and movable between an engaged condition and an disengaged condition. More preferably, such engaging means comprises four tray lift members appropriately mounted on opposing end portions of the pick-up head to provide tray engaging capabilities. The tray lift members may be further movable to a retracted condition wherein the tray lift members do not interfere with engagement of sticks of container ends by the pick-up head.

In another aspect of the invention, the transport device possesses significant vertical travel capabilities such that the pick-up head may be moved vertically to deposit sticks into trays at different heights and to develop stacks of trays, as described above. By way of example, the transport device may comprise a horizontal articulated robot, or any other suitable robotic mechanism having vertical travel capabilities. This feature is beneficial for providing a transport device which can load sticks into the top of a stack of trays regardless of the number of trays in the stack (i.e., regardless of the vertical position of the top-most tray). For example, the transport device can load sticks into a single tray located at one level and can subsequently load sticks into a tray stacked on ten other trays at a different level. Such vertical travel capabilities are further useful for providing a transport device which can engage trays and deposit them on other trays to create a stack of trays, as described above in more detail.

If desired, the loading area(s) may be defined by a platform (i.e., for supporting the stack of trays) having vertical height adjustment capabilities. For example, the platform may be equipped with a scissor mechanism capable of raising and lowering the platform (i.e., and the stack of trays thereon) to place the top-most tray at a convenient height. Used in combination with a transport device having vertical travel capabilities, the assembly can be programmed to form a stack of trays having a height beyond the travel range of either the transport device or platform individually. By way of example, the platform initially can be raised to allow a stack of trays (e.g., about thirteen trays) to be formed thereon by the transport device. Subsequently, the platform can be lowered (e.g., such that the top-most tray is vertically positioned approximately level with the original height of the base platform) to allow more trays to be stacked thereon to form a larger stack of trays (e.g., about twenty-seven trays total). It can be appreciated that, even though twenty-seven trays are formed into a stack, the transport device only needs to have a range of travel sufficient to stack thirteen or fourteen trays, thus allowing for the use of a smaller (i.e., less space-consuming and typically less expensive) transport device.

The palletizing assembly may further comprise a discharge subassembly for receiving a stack of filled trays from the loading area(s) and providing the stack to one or more discharge areas. In the above-described embodiment, wherein two conversion presses are being serviced by a single transport device, two such discharge subassemblies may be provided to maintain the container ends from each conversion press separate from each other. Preferably, the discharge subassembly comprises a conveyor means for connecting the loading areas (i.e., where the trays are loaded and stacked) with one or more downstream buffer areas, and for connecting the buffer area(s) with the discharge area(s). The conveyor means may comprise at least one powered conveyor for moving the stack of trays from the loading areas to the discharge area(s).

In yet another aspect of the invention, the discharge subassembly includes one or more staging sensors for sensing the presence of a load of trays in the staging areas and one or more discharge sensors for sensing the presence of a stack of trays in the discharge area(s). Such sensors may be operatively connected to a control means which selectively activates/deactivates the transport device under certain conditions. For example, if all of the respective sensors indicate that a stack of trays is present in each of the respective areas, the control means will deactivate the tray loading subassembly to prevent overflow of the palletizing assembly. Such sensors may also be utilized to control the movement of stacks of trays from the tray loading areas to the discharge area(s).

The present invention may further comprise a depalletizing assembly for unloading sticks of container ends from a stack of filled trays and depositing the sticks into troughs for supplying container filling machines. The depalletizing assembly generally comprises a tray stack supply subassembly for receiving stacks of filled trays at a supply area (e.g., from a fork lift) and transporting the stacks to an unloading area, and a tray unloading subassembly for removing sticks of container ends from the unloading area and depositing them into a deposit area for supplying can filling machines.

The tray stack supply subassembly may comprise multiple conveyors defining the supply area, intermediate downstream staging areas, and a downstream unloading area at which the trays are unloaded. Such conveyors may be of the type described above for the discharge subassembly of the palletizing assembly. Sensors may also be provided for controlling the flow of the stacks between the supply area and the unloading area.

The tray unloading subassembly comprises a transport device having a pick-up head similar to that described above for the tray loading subassembly. In addition, the pick-up head may be capable of engaging and moving an empty tray from the unloading area (i.e., after the tray has been unloaded) to an empty tray area. As such, the tray unloading assembly will unload one or more sticks (e.g., two at a time) from the top-most tray and deposit the sticks into a deposit area (e.g., in troughs). Once a tray is completely unloaded, the pick-up head will transport the empty tray to the empty tray area so that the subsequent tray may be unloaded. Once a complete stack is unloaded, a new stack may be provided to the unloading area by the tray stack supply subassembly.

The deposit area, into which the sticks are deposited, may include troughs which provide a pathway for supplying a continuous array of container ends to a filling machine. The troughs are preferably inclined to prevent the container ends on the upstream ends of the sticks from falling over. However, as noted above, instead of being inclined, the troughs may comprise resilient rails (e.g., rubber strips) for engaging the perimeter portion of the stick to prevent container ends from falling over during transport and consolidation.

In order to provide smooth consolidation of the deposited sticks with the continuous array, sensors are provided for controlling the positioning of the consolidated array relative to the deposit area. More specifically, one or more warning sensors are positioned about one third the length of the deposit area from the downstream end thereof in order to signal the unloading subassembly that a new stick will soon be required. One or more clearance sensors are located slightly downstream of the deposit area and signals the unloading subassembly that there is sufficient clearance for depositing a new stick into the deposit area. One or more shut-off sensors are located slightly downstream of the clearance sensor(s) and will deactivate the corresponding filling machine if the upstream end of the array passes thereby. By appropriately positioning the above-described sensors, the sticks will be deposited immediately adjacent the array such that the downstream end of the deposited stick will be supported by the upstream end of the array, thereby enhancing consolidation of the stick with the array by preventing the container ends of the stick from falling over.

DETAILED DESCRIPTION

Figure 1:
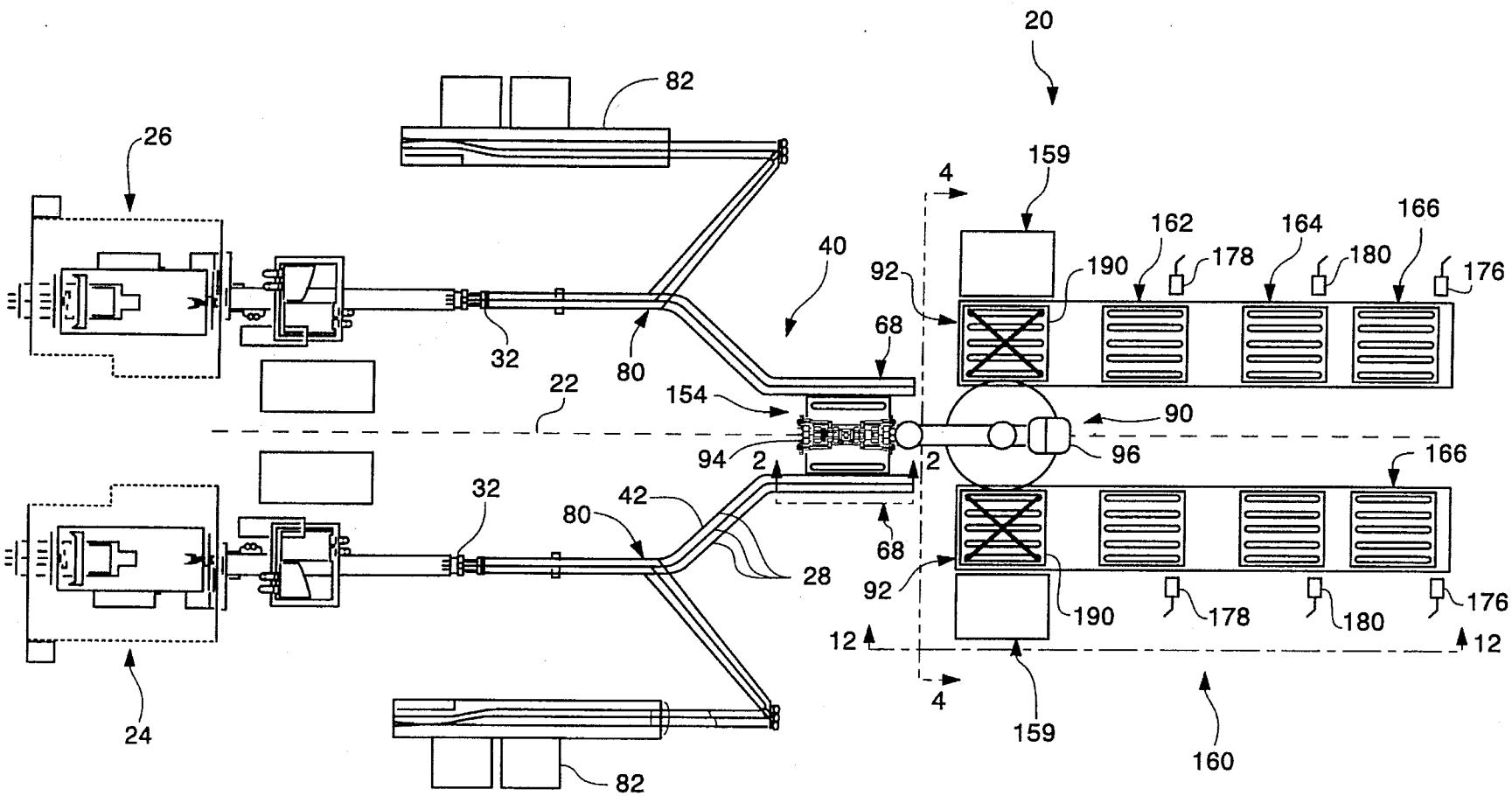
FIG. 1 is a plan view of a container end palletizing assembly embodying features of the present invention.

FIG. 1 illustrates an automated container end palletizing assembly 20 embodying the features of the present invention. For ease of description, in the discussion of the end palletizing assembly 20, the following terminology will be used. The direction of flow of the container ends will be termed the "downstream direction" and corresponds with movement from left to right in FIGS. 1 and 2. The opposite direction will be termed the "upstream direction" and corresponds with movement from right to left in FIGS. 1 and 2. The "array" of container ends refers to the plurality of container ends in face-to-face relation as they exit a conversion press, but before being counted and separated. A "stick" of container ends refers to a counted and separated group of container ends. The "path" of container ends refers to the volume of space within a trough through which the container ends travel between the conversion presses 24,26 and the pick-up areas 68.

As shown in FIG. 1, the assembly is a virtual mirror image about a central longitudinal axis 22 which divides the assembly into two sides. That is, the flow of container ends from the first conversion press 24 all the way through to the discharge area 166 on the same side is, for all practical purposes, identical to the flow of container ends from the second conversion press 26 to the discharge area 166 on the other side. For ease of description, only one of the two sides of the assembly will be described herein. Unless otherwise indicated, any reference to the described side of the assembly will apply equally to the non-described side.

Briefly, the end palletizing assembly illustrated in FIGS. 1–17 is designed to receive multiple arrays 28 of container ends (e.g., three arrays 28 from each of two conversion presses 24,26) and load the container ends into trays 190 which are stacked on a pallet 34 and provided to a discharge area 166. More specifically, referring to FIGS. 1 and 2, a supply subassembly 40 receives multiple arrays 28 from the conversion press 24, separates the arrays 28 into sticks 30, and provides the sticks 30 to a pick-up area 68. The sticks 30 are subsequently transported from the pick-up area 68 and deposited into trays 190 at a loading area 92 utilizing a tray loading subassembly 90. When a tray 190 is full of sticks 30, the tray loading subassembly 90 retrieves an empty tray 190 from an empty tray area 154 and places the empty tray 190 onto the full tray 190 in the loading area 92. This process continues until a complete stack of filled trays is formed in the loading area 92, at which time a discharge subassembly 160 transports the stack of filled trays from the loading area 92 to a discharge area 166.

Having generally described the end palletizing assembly, each of the various subassemblies will be described in more detail below. Although it may be desirable to incorporate all subassemblies into a given palletizing process, since the various subassemblies each contribute in some respect to the palletizing process, they may also be individually incorporated into existing devices to enhance their operational characteristics.

Each supply subassembly 40 receives three arrays 28, separates the arrays 28 into sticks 30 in a separating area 48, moves the sticks 30 to a staging area 50, and subsequently transports the separated sticks 30 to a pick-up area 68. In this regard, each supply subassembly 40 includes three troughs 42 for facilitating transport of the container ends from the conversion press outlet 32 to the pick-up area 68 such that container ends may be transported therebetween, as shown in FIGS. 1–3. As shown in FIG. 2, the troughs 42 are inclined about 20° as the troughs 42 approach the pick-up area 68. Such inclination of the troughs 42 assists in maintaining the container ends in an upright, nested condition during the stick-forming process, as described in more detail below. Although a variety of trough configurations may be appropriate, in one embodiment, the troughs 42 are substantially semi-circular or U-shaped, as illustrated in FIG. 3. Furthermore, in the staging area 50, the troughs 42 each include a slot 43 in a lower portion thereof for providing access to the path of container ends by the shuttle finger 62 from below the trough, as described in more detail below.

As noted above, each supply subassembly 40 of the illustrated embodiment includes three troughs 42 for receiving three arrays 28 from a conversion press 24. For each trough, the supply subassembly 40 further includes a separator 44 for separating sticks 30 from the incoming array 28 of ends, and a shuttle 60 for transporting the stick 30 from the staging area 50 to the pick-up area 68. Since the separator 44 and shuttle 60 are essentially identical for each trough, the configuration and operation of only one separator 44 and shuttle 60 will be described herein. Unless otherwise indicated, any reference to the described separator and shuttle 60 will apply equally to the non-described separators and shuttles for the other troughs 42 (including the troughs 42 of the non-described supply subassembly 40).

The separator 44 includes a counting device 46 for counting a predetermined number of container ends passing the counting device 46 and for generating a counting signal in response thereto. An appropriate counting device 46 is disclosed in U.S. Pat. No. 5,163,073 to Chasteen et al., which is hereby incorporated by reference. The counting signal is provided to a control means (not shown), such as a microprocessor, for controlling the operation of the various elements of the palletizing assembly. Upon receipt of the counting signal from the counting device 46, the control means directs the separator 44 to separate the stick 30 from the array 28 and transport the stick 30 in the downstream direction from the separating area 48 to the staging area 50 to provide a gap between the stick 30 and the array 28. To accomplish such separation, the separator 44 further includes a separating finger 52 operatively connected to a separating actuator 54 for movement into and out of the path of container ends (i.e., into and out of the trough). In the described embodiment, the separating actuator 54 comprises an air cylinder, but could instead comprise any appropriate actuator. To provide transport capabilities, the separating actuator 54 is mounted to a longitudinal separating cylinder 56 for movement in the downstream and upstream directions. The separating cylinder 56 of the illustrated embodiment comprises a rodless cylinder, such as cylinders sold under the trade name Orega, but could instead comprise any appropriate linear actuator.

Figure 2A:
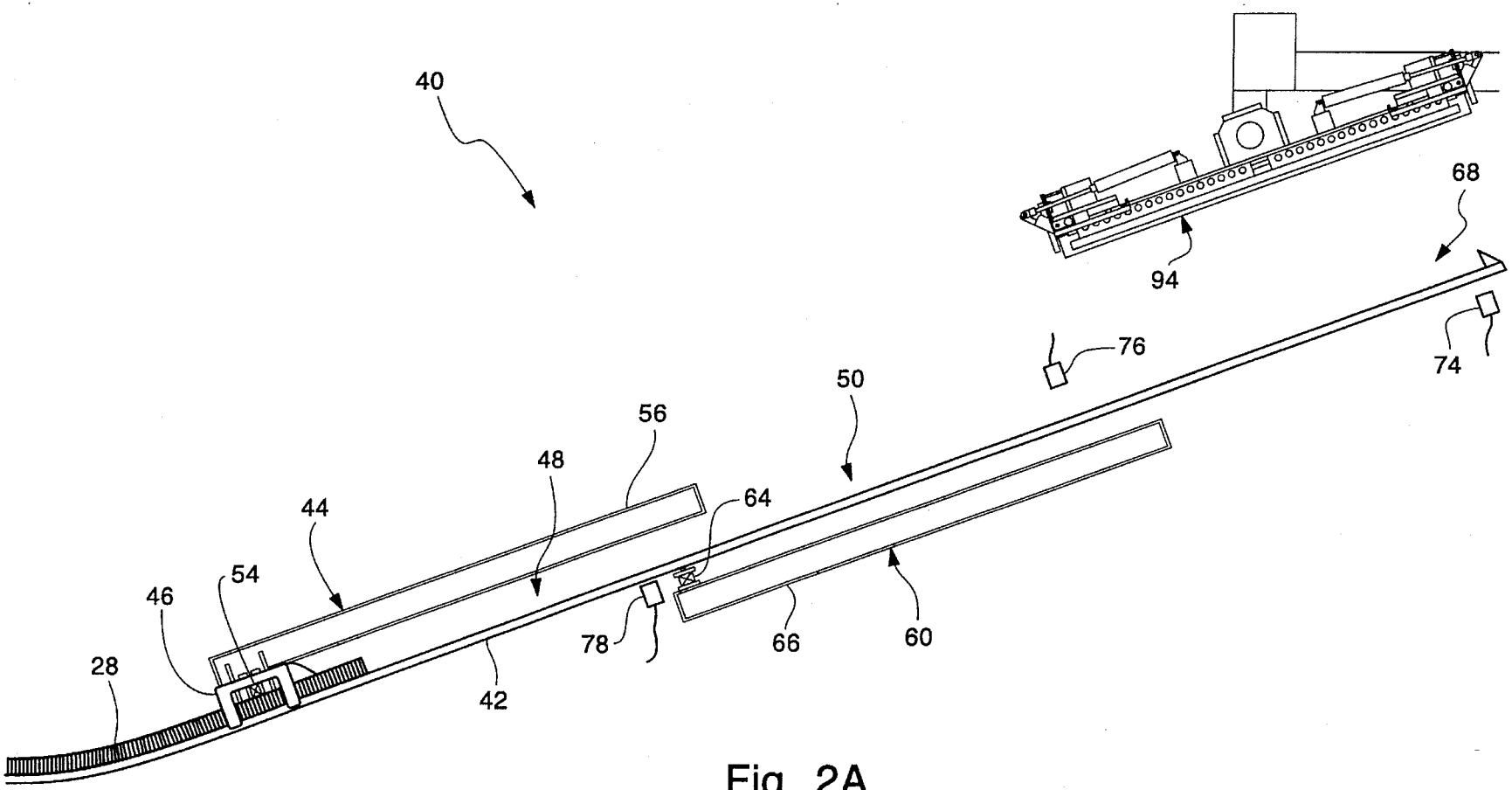
FIG. 2*a* is an elevation view of the supply subassembly taken along line 2—2 in FIG. 1.
Figure 2B:
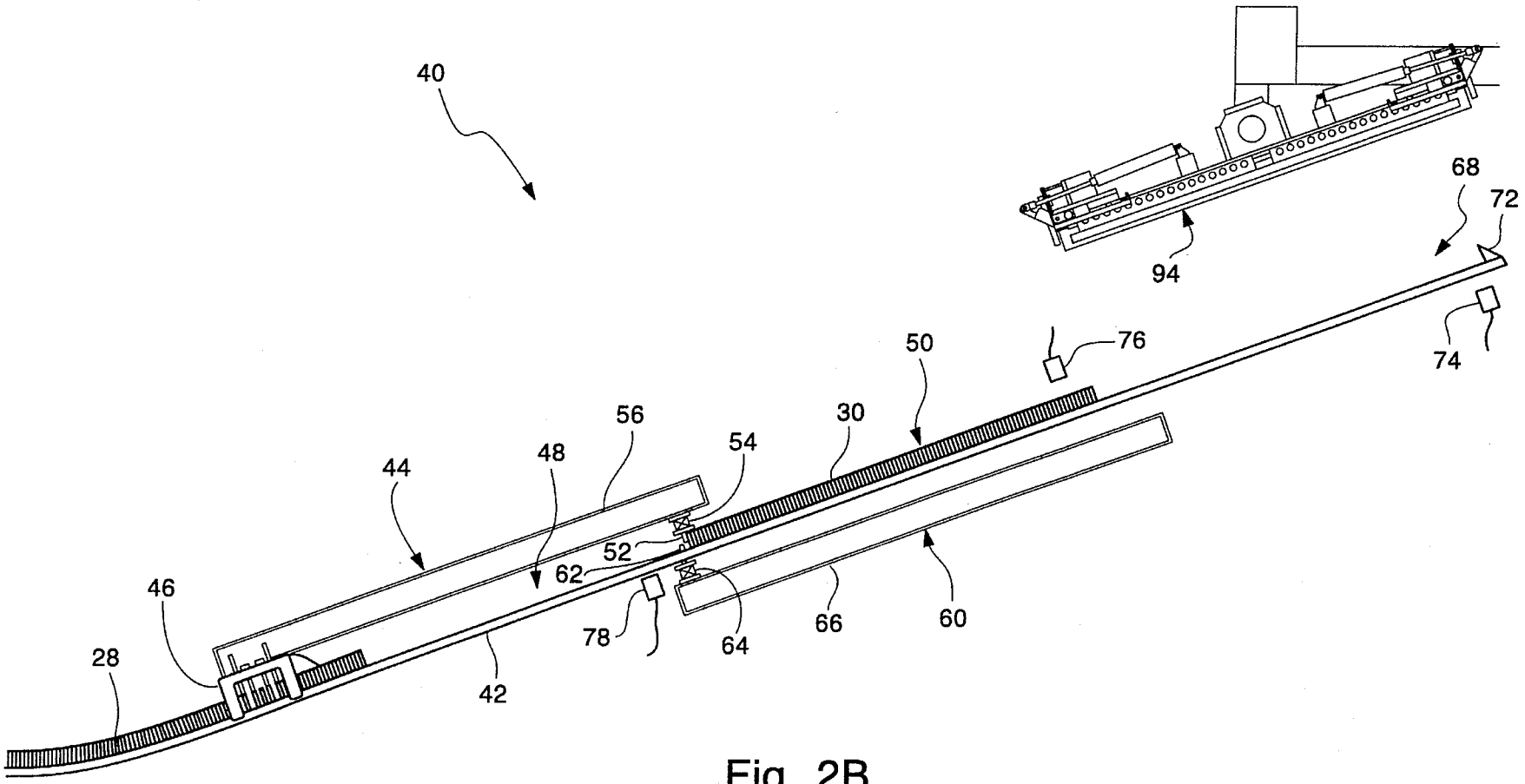
FIG. 2*b* is the elevation view of FIG. 2*a* showing a stick of container ends positioned in the staging area by the separator.
Figures 2D, 3:
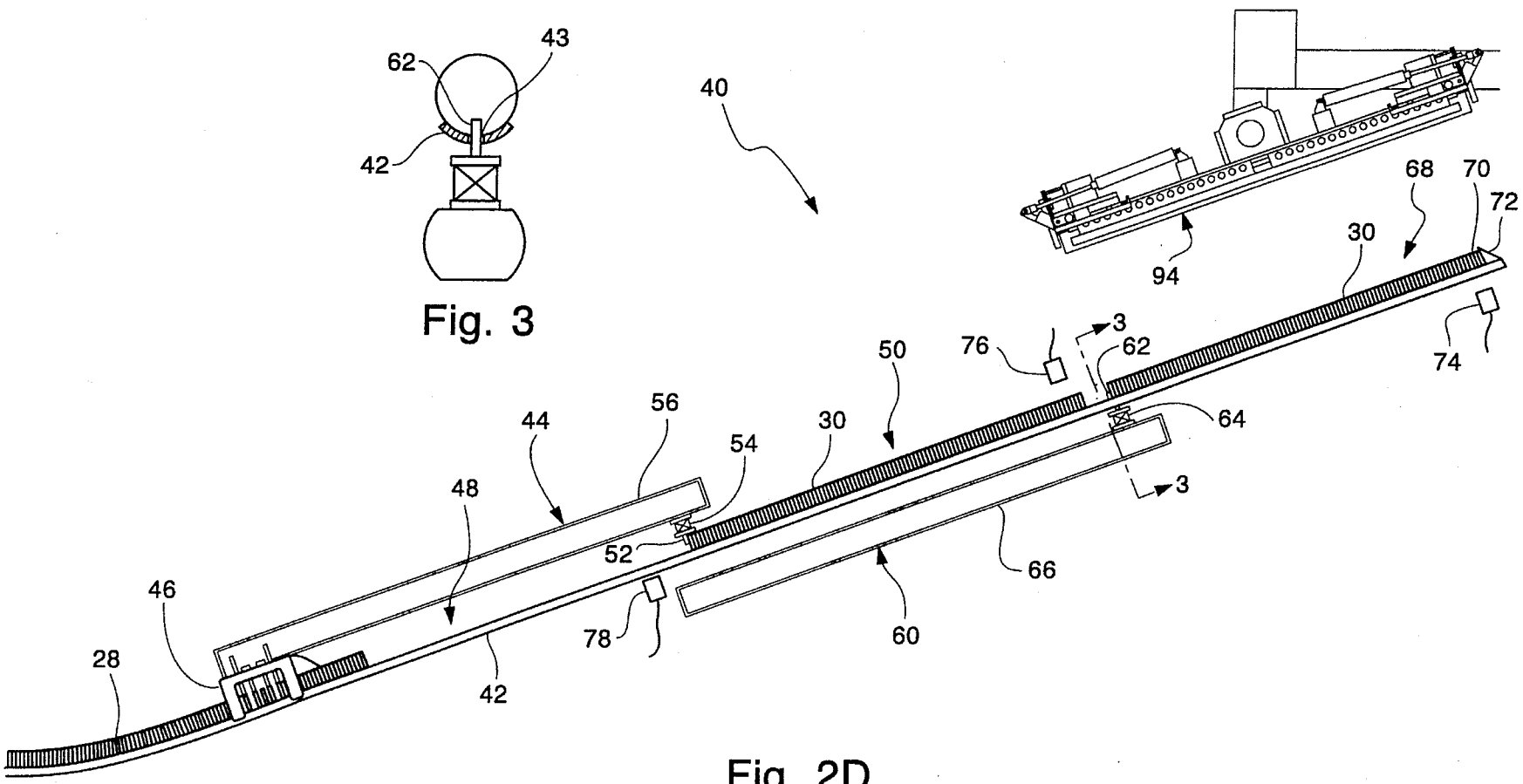
FIG. 2*d* is the elevation view of FIG. 2*a* with a stick container ends positioned in the pick-up area in preparation for engagement by the tray-loading subassembly.
FIG. 3 is a section view of the supply subassembly taken along line 3—3 in FIG. 2*d;*

In operation, the separating finger 52 is initially positioned adjacent the counting device 46 in a retracted position (i.e., out of the path of container ends), as shown in FIG. 2*a*. When the separating device receives a signal from the control means (i.e., indicating that the counting device 46 has counted a predetermined number of container ends passing therethrough), the separating actuator 54 is activated to insert the separating finger 52 into the path of container ends such that a stick 30 is separated from the array 28. The separating cylinder 56 is subsequently activated to transport the separating actuator 54 and separating finger 52 downstream to position the stick 30 from the separating area 48 to the staging area 50, as shown in FIG. 2*b*. The separator 44 holds the stick 30 in the staging area 50 until the shuttle 60 engages the stick 30, as described below. The separator 44 subsequently returns the separating finger 52 to the initial retracted position adjacent the counting device 46 to await another signal from the control means.

As noted above, the supply subassembly 40 further includes a shuttle 60 for moving a stick 30 from the staging area 50 to the pick-up area 68. As shown in FIGS. 2*a*–2*d*, the shuttle 60 is essentially identical to the separating portion of the separator 44, except that it is positioned below the staging area 50 (i.e., below the trough) rather than above the separating area 48. Such positioning of the shuttle 60 below the trough 42 provides enhanced access to the pick-up area 68 (e.g., for engagement of the sticks 30 by the pick-up head 94 of the tray loading subassembly 90). The shuttle 60 includes a shuttle finger 62 operatively connected to a shuttle actuator 64 (e.g., an air cylinder) for moving the shuttle finger 62 into and out of the path of container ends. To provide transport capabilities, the shuttle actuator 64 is mounted to a shuttle cylinder 66 (e.g., a rodless cylinder) for movement in the downstream and upstream directions.

Figure 2C:
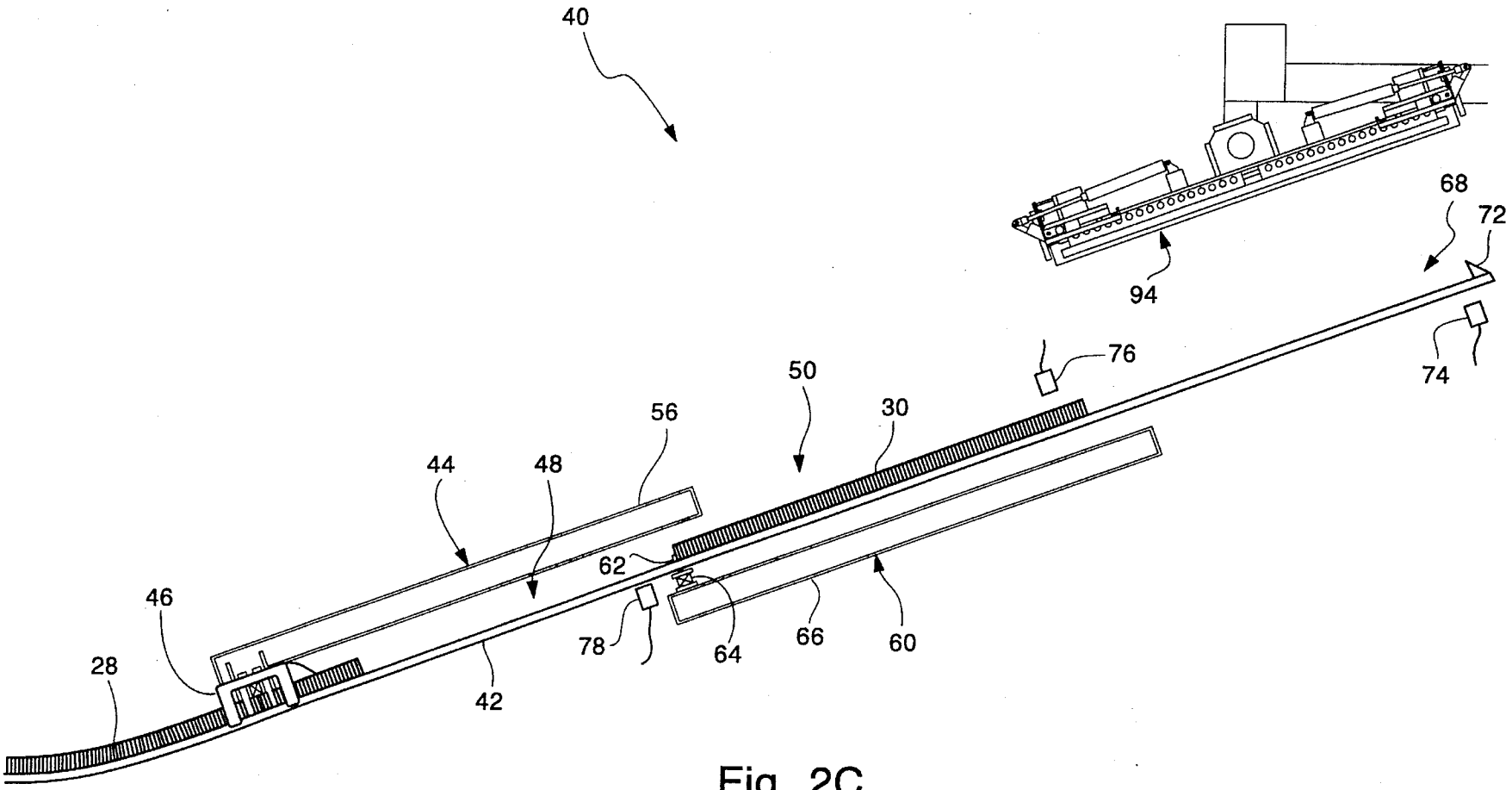
FIG. 2*c* is the elevation view of FIG. 2*a* with the shuttle supporting a stick in the staging area and with the separator returned to its initial position adjacent the counting device.

In operation, the shuttle finger 62 is initially positioned near the downstream end of the staging area 50 in a retracted position (i.e., out of the path of container ends), as shown in FIG. 2*a*. Once the separator 44 has appropriately positioned a stick 30 in the staging area 50, the shuttle actuator 64 will be activated to insert the shuttle finger 62 into the path of container ends upstream of the stick 30, as shown in FIG. 2*b*. Consequently, when the separator 44 retracts the separating finger 52 and returns to a position adjacent the counting device 46, the shuttle finger 62 is left supporting the stick 30, as shown in FIG. 2*c*. The shuttle cylinder 66 is subsequently activated to transport the stick 30 from the staging area 50 to the pick-up area 68, as shown in FIG. 2*d*. During such transport, the downstream end 70 of the stick 30 contacts a stop member 72 and the shuttle 60 continues to travel downstream a short distance to slightly compress the stick 30. The shuttle 60 holds the stick 30 in the pick-up area 68 until the tray loading subassembly 90 engages the stick 30 and removes it from the pick-up area 68, as described below. Once the stick 30 has been removed, the shuttle 60 returns to its initial position (i.e., near the downstream end of the staging area 50), shown in FIG. 2*a*, to await another stick 30 to be supplied to the staging area 50 by the separator 44.

Figure 4:
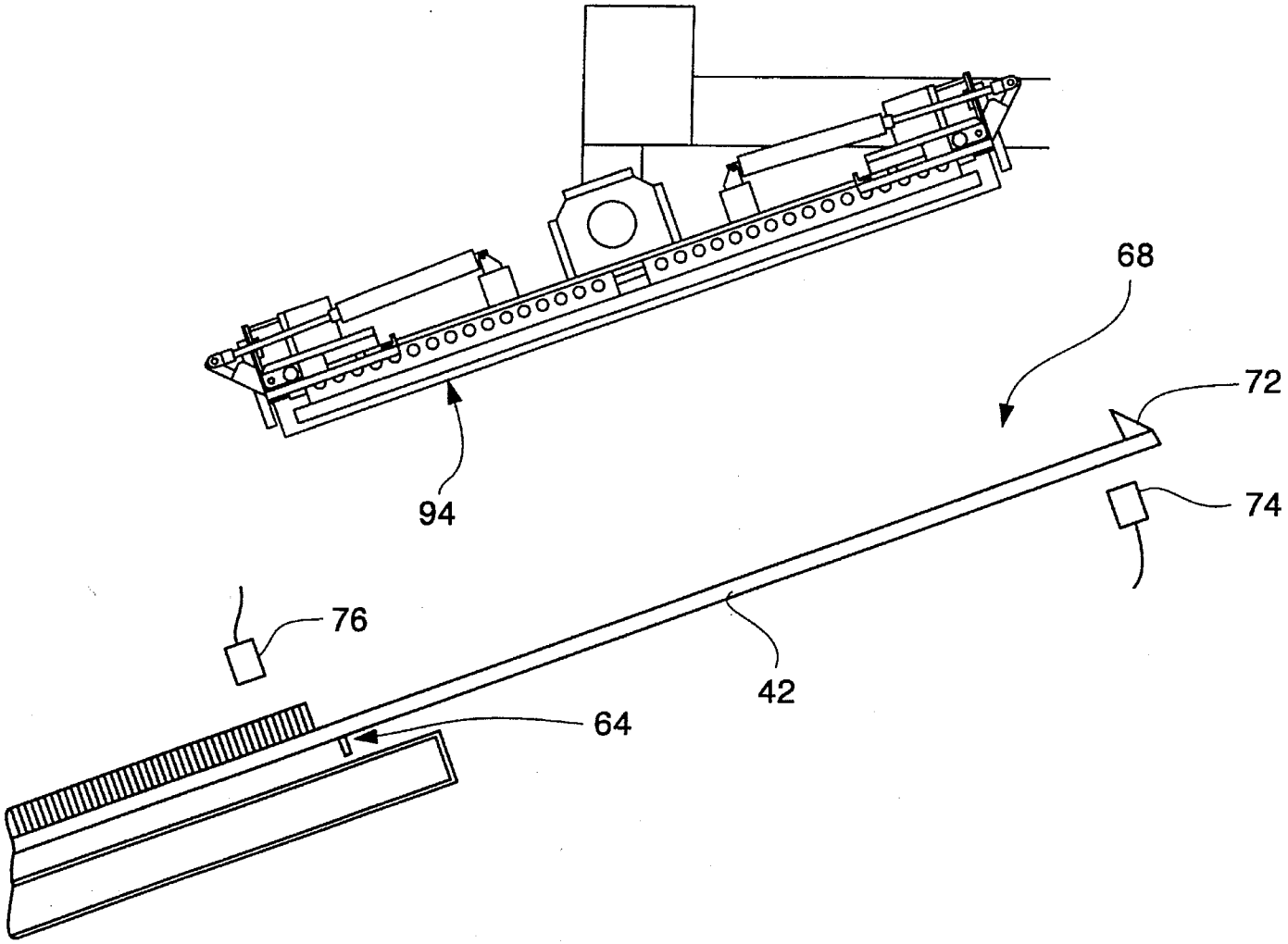
FIG. 4 is an elevation view of an alternative embodiment showing the approximate positioning of the one-way stop device.
Figure 5A:
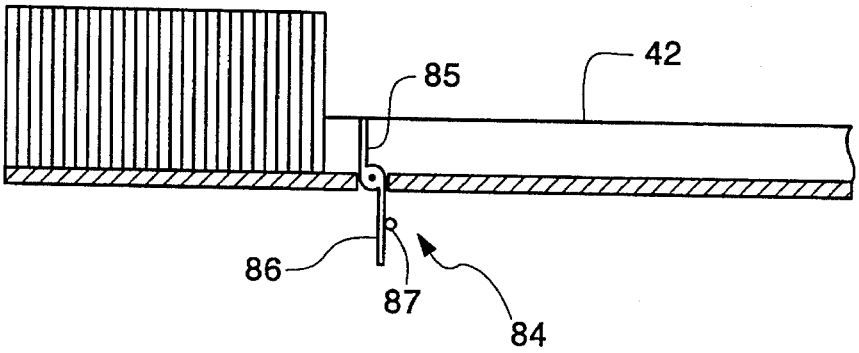
FIG. 5*a* is a longitudinal section view of the alternative embodiment shown in FIG. 4 with the one-way stop device in the first position as a stick is approaching.
Figure 5B:
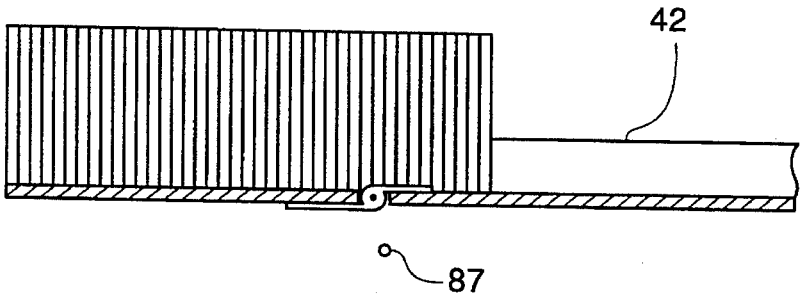
FIG. 5*b* is the longitudinal section view of FIG. 5*a* with the one-way stop device in the second position as a stick passes over the device.

In an alternative embodiment, instead of requiring the shuttle 60 to hold the stick 30 in the pick-up area 68 until the tray loading subassembly 90 engages the stick 30 and removes it from the pick-up area 68, the supply subassembly 40 may include a one-way stop device 84 for allowing movement of sticks 30 downstream, but substantially preventing movement upstream, as shown in FIG. 4. More specifically, the one-way stop device 84 may comprise a stop paddle 85 positioned within the trough 42 near the upstream end of the pick-up area 68, and pivotable with respect thereto between a first position (FIG. 5*a*) and a second position (FIG. 5*b*). A depending member 86 is interconnected with the stop paddle and pendulently depends therefrom such that the stop paddle 85 is biased toward the first position. The stop paddle 85 is substantially prevented from pivoting in the upstream direction due to the presence of an interfering boss 87. The stop paddle 85 is designed such that, when in the second position, it does not substantially interfere with movement of sticks in the downstream direction.

Figure 5C:
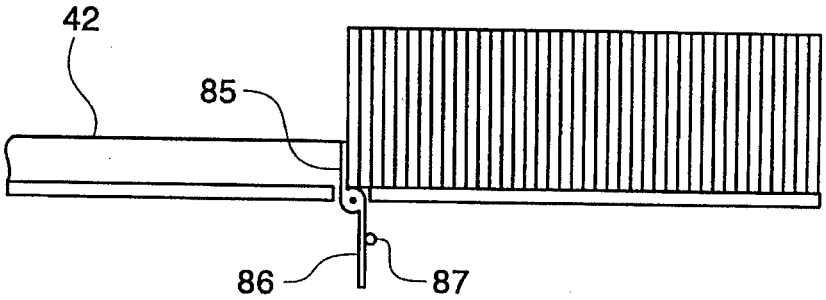
FIG. 5*c* is the longitudinal section view of FIG. 5*a* with the one-way stop device in the first position supporting the upstream end of the stick.

When a stick 30 is transported from the staging area 50 to the pick-up area 68, the stick will engage the stop paddle 85 and cause the stop paddle 85 to pivot from the first position (FIG. 5*a*) to the second position (FIG. 5*b*). The stop paddle 85 will remain in the second position until the upstream end of the stick 30 passes thereby, at which time the stop paddle 85 will rotate to the first position (i.e., due to the biasing force provided by the depending member). As noted above, the shuttle 60 slightly compresses the stick 30 against the stop member 72. Subsequent removal of the shuttle finger 62 from the stick 30 will cause the stick 30 to expand slightly until the upstream end thereof contacts the stop paddle 85 (FIG. 5*c*). Because the stop paddle is prevented form rotating in the upstream direction (i.e., due to the interfering boss 87), the stop paddle 85 will support the upstream end of the stick 30 until the stick 30 is engaged and removed by the tray loading subassembly 90. It should be noted that, to avoid interference with the one-way stop device 84 in this embodiment, the shuttle may be positioned on the side of the trough, rather than directly under the trough.

The supply subassembly 40 is further provided with sensors for monitoring the status of incoming sticks 30. More specifically, the supply subassembly 40 includes a pick-up sensor 74, operatively connected to the control means, for sensing the presence of a stick 30 in the pick-up area 68. A staging sensor 76 is operatively connected to the control means and senses the presence of a stick 30 in the staging area 50. Similarly, a separating sensor 78 is operatively connected to the control means and senses the presence of a stick 30 in the separating area 48. The sensors may comprise any appropriate means for sensing the presence of a stick 30 at a particular location. For example, the sensors may comprise mass sensors or photo-eye sensors.

The three sensors 74,76,78 are collectively utilized by the control means to prevent overflow of the system caused by a fault downstream of the supply subassembly 40. For example, if the three sensors indicate that there is a stick 30 in each of the three areas (i.e., the pick-up area 68, the staging area 50 and the separating area 48), the control means will deactivate the source (i.e., the conversion press 24) of the array 28. Such a deactivating mechanism is beneficial in that it prevents the array 28 from running into the previously-counted stick 30 and further ensures that the separating finger 52 is properly positioned adjacent the counting device 46 in order to provide accurate separation of the stick 30 from the array 28. The deactivated conversion press 24 can then be automatically restarted once the downstream fault has been corrected. Furthermore, the pick-up sensor 74 can be used as an indication that a stick 30 is ready to be picked-up by the tray loading subassembly 90. It should further be noted that the control (i.e., activation and deactivation) of one conversion press 24 does not affect the operation of the other conversion press 26.

As an alternative to deactivating the conversion press 24 in response to overflow of the system caused by a fault downstream, the array 28 exiting the conversion press 24 may be diverted to a backup container end processing station. For example, referring to FIG. 1, the control means may be operatively connected to a trough diversion switch 80 for diverting the array 28 to another processing station 82. Such processing station 82 may include a manual palletizing station or an automatic or manual bagging station. Such backup processing station 82 can accommodate system overflow while providing for uninterrupted operation of the conversion press 24 during times of downstream system faults.

Figure 6:
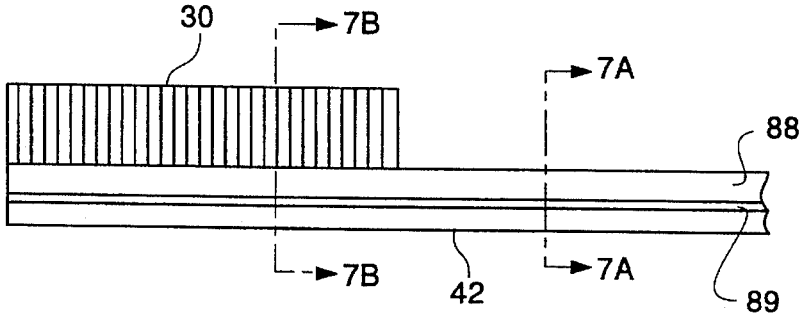
FIG. 6 is an elevation view of an alternative embodiment showing a horizontal trough with attached resilient rails.
Figure 7A:
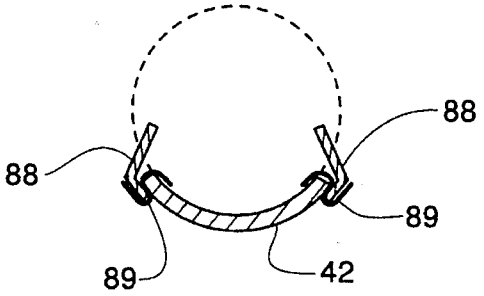
FIG. 7*a* is a section view taken along line 7*a*—7*a* in FIG. 6 showing an end view of the resilient rails in their natural state.
Figure 7B:
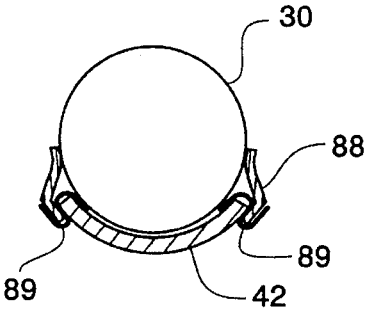
FIG. 7*b* is a section view taken along line 7*b*—7*b* in FIG. 6 showing an end view of the resilient rails as they are deformed by the stick.
Figure 8:
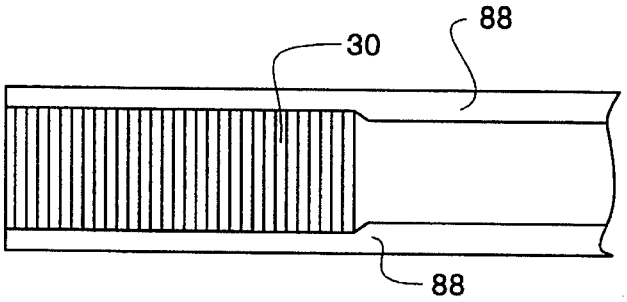
FIG. 8 is a section view taken along line 8—8 in FIG. 6 showing a top view of the resilient rails as they are deformed by the stick.

In an alternative embodiment, instead of utilizing a trough 42 which is inclined, the supply subassembly 40 may utilize a substantially horizontal trough, as shown in FIG. 6. In this regard, in order to maintain the container ends in an upright nested condition (i.e., such that the container ends on the ends of each stick do not fall over during transport and pick-up thereof), the horizontal trough 42 may include resilient rails 88 mounted on either side thereof and extending slightly into the path of container ends, as shown in FIG. 7*a*. The resilient rails 88 comprise a resilient material, such as rubber, and are designed to contact opposing sides of the stick 30, as shown in FIG. 7*b*, while the stick is transported from the separating area 48 to the pick-up area 68. Referring to FIG. 8, the resilient rails 88 wrap around the ends of the stick 30 to thereby maintain the container ends on the ends of the stick 30 in an upright condition. The resilient rails 88 are frictionally mounted to the trough 42 through the use of S-shaped mounting rails 89 which facilitate replacement of the resilient rails 88 when they become worn out. The use of a horizontal trough 42 simplifies the assembly 20 by not requiring that the pick-up head 94 have tilting capabilities.

It should be appreciated that the resilient rails 88 could also be utilized with the above-described embodiment having an inclined trough 42. More specifically, the resilient rails 88 can be designed with sufficient holding force such that they prevent a stick 30 from sliding down the inclined trough 42 due to the force of gravity. Such resilient rails 88 obviate the need for the separator 44 and/or the shuttle 60 to hold the stick 30 in the staging area 50 in preparation for transport to the pick-up area 68.

Referring now to FIG. 1, the tray loading subassembly 90 is designed to engage sticks 30 positioned in the pick-up area 68 (i.e., by the supply subassembly 40) and transport the sticks 30 to the appropriate loading area 92 where the sticks 30 are deposited into channels in trays 190. The tray loading subassembly 90 of the present embodiment includes a pick-up head 94 for selectively engaging and disengaging three sticks 30 simultaneously, and a transfer mechanism 96 for selectively moving the pick-up head 94 between the pick-up areas 68 and the tray loading areas 92. In this regard, it should be noted that the palletizing assembly of the illustrated embodiment utilizes only one tray loading subassembly 90 (i.e., only one pick-up head 94 and one transfer mechanism 96) to service both sides of the assembly. That is, a single tray loading subassembly 90, appropriately positioned near the pick-up areas 68 and loading areas 92, can provide tray loading services for both conversion presses 24,26. Further, a disruption in the operation of one side of the assembly does not affect the operation of the other side.

In one aspect of the invention, as noted briefly above, sticks 30 engaged from the three troughs 42 on one side of the assembly are only deposited in the loading area 92 on the same side. Correspondingly, sticks 30 engaged from the three troughs 42 from the other side of the assembly are only deposited in the loading area 92 on the other side. As such, all of the container ends on a particular pallet 34 will have been processed on the same conversion press. Such separation of container ends from different conversion presses can provide substantial advantages in the manufacturing process, most notably for quality control purposes. For example, if it is known that a particular conversion press produced defective container ends during a particular run, entire pallets of container ends can be rejected and/or reworked, rather than having to sort through individual sticks within individual trays of a stack of trays and/or rejecting whole pallets of ends which may contain a mix of defective and non-defective ends. Furthermore, container ends having different configurations can be produced on adjacent conversion presses and can be loaded and palletized utilizing a single tray loading subassembly 90, without risk that the ends will become mixed.

Figure 9:
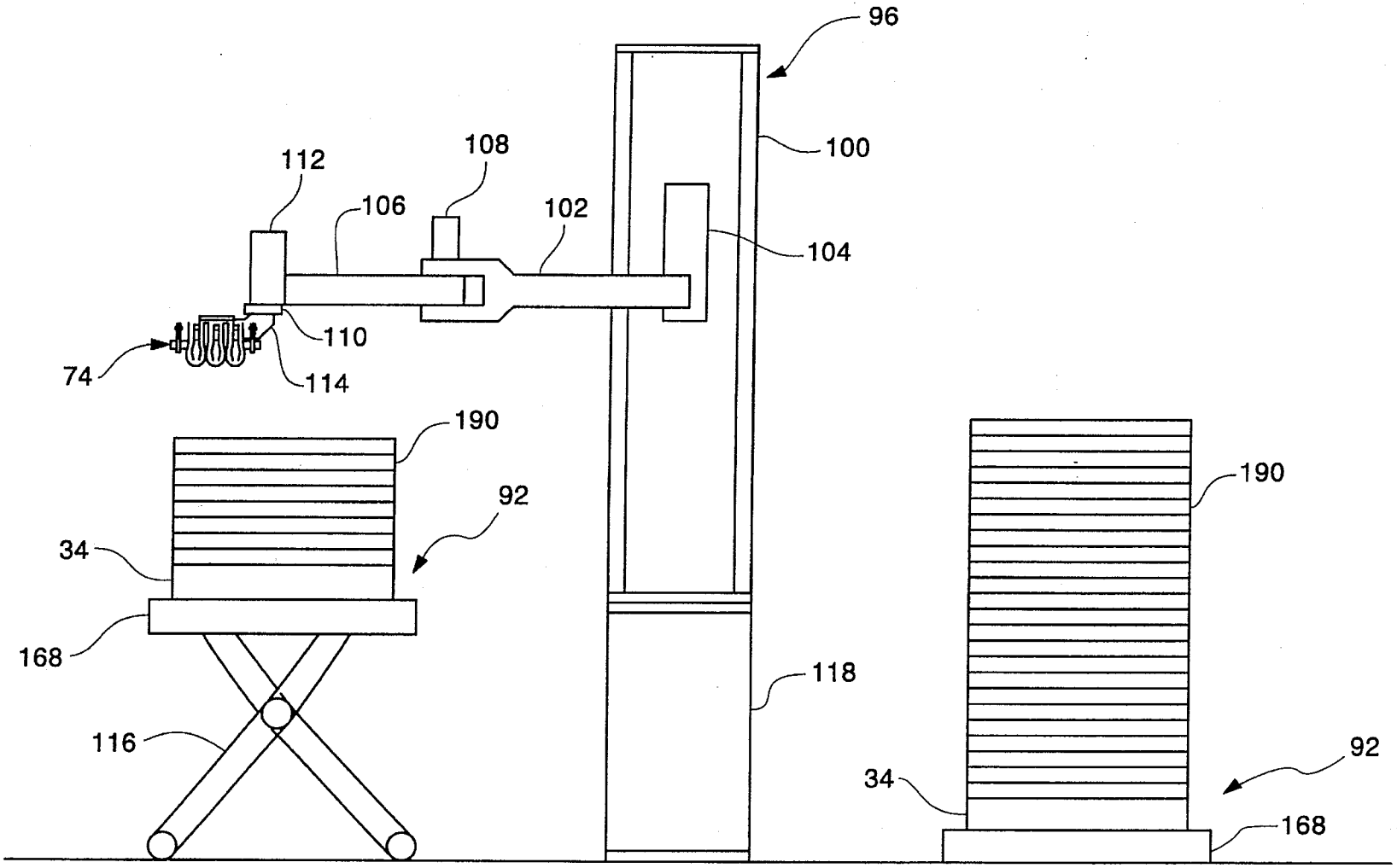
FIG. 9 is an elevation view of the tray-loading subassembly taken along line 9—9 in FIG. 1.
Figure 10:
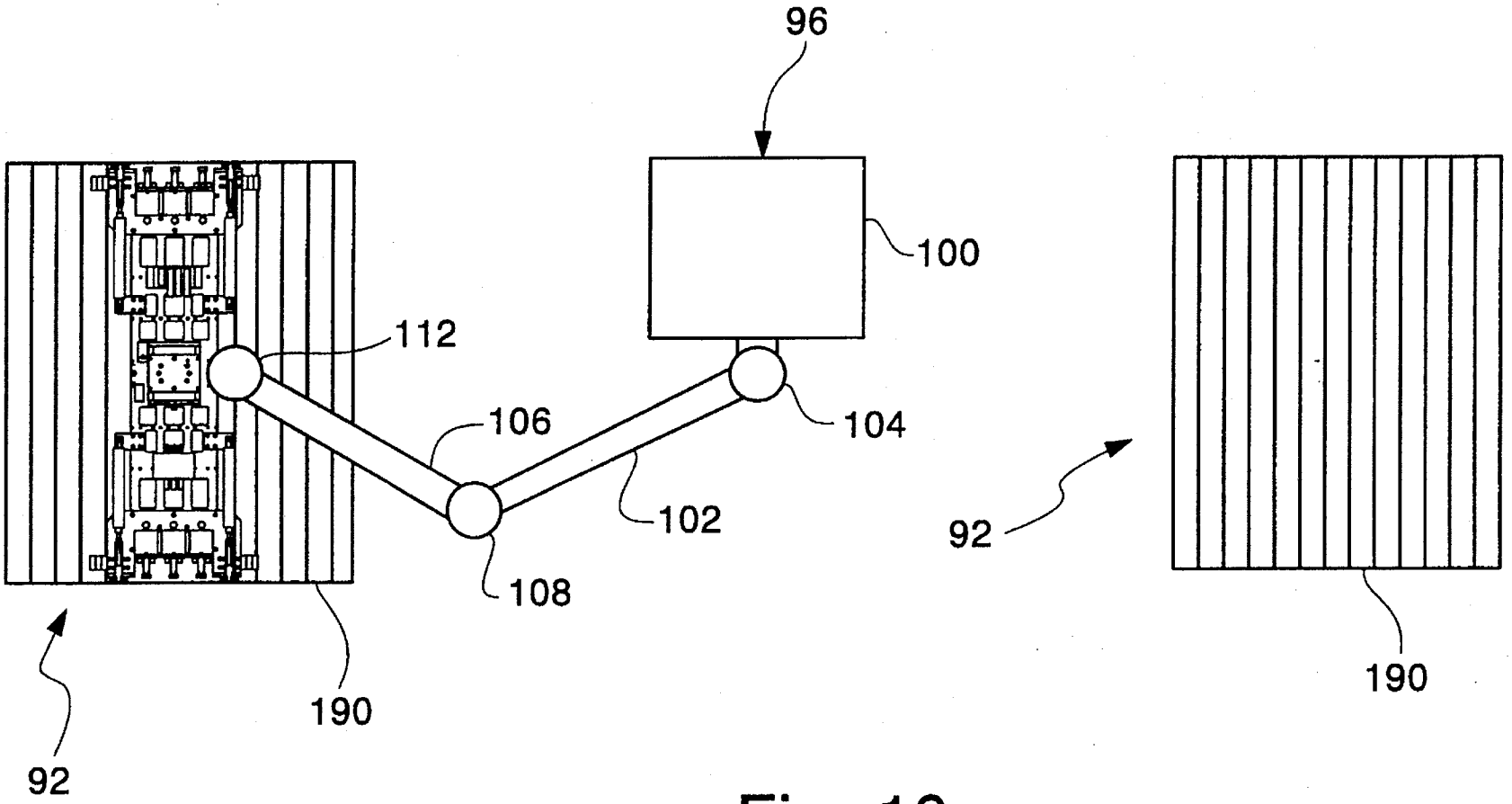
FIG. 10 is a plan view of the tray-loading subassembly.

Referring to FIGS. 9 and 10, the transfer mechanism 96 of the described embodiment comprises a horizontal articulated robot. The robot 96 includes a vertical actuator 100 for providing vertical movement to the pick-up head, a first arm 102 mounted to the vertical actuator 100 and driven by a first rotary actuator 104, a second arm 106 operatively connected to the first arm 102 and driven by a second rotary actuator 108, and a mounting plate 110 operatively connected to the second arm 106 and driven by a third rotary actuator 112. Such first and second rotary actuators 104,108 provide horizontal articulated motion to the first and second arms 102,106. The third rotary actuator 112 provides rotation about a vertical axis to the mounting plate 110 and any associated components (e.g., the pick-up head). A fourth rotary actuator 114 is horizontally mounted to the mounting plate 110 for providing tilting motion to the pick-up head. A robot 96 meeting the above specifications can be obtained from Fanuc Robotics Corporation under the model designation M-400.

The loading area 92 of the illustrated embodiment is defined by a loading conveyor 168 which, after a stack of full trays is formed, assists in transporting the stack of trays to a discharge area, as described below in more detail in the description of the discharge subassembly 160. As shown in FIG. 9, the loading conveyor 168 has vertical height adjustment capability which assists in the tray loading process. More specifically, in the illustrated embodiment, it has been determined that an optimal stack of trays comprises about 27 full trays 190 having a height of about 6 feet. Because of the difficulty and expense in obtaining a vertical actuator 100 having a travel of at least 6 feet, it has been determined that it would be beneficial to provide a loading conveyor 168 having the ability to travel vertically. In this regard, the loading conveyor 168 of the illustrated embodiment includes a scissor mechanism 116 which can selectively raise and lower the loading conveyor 168 from ground level up to about 4 feet. With such an arrangement, the loading conveyor 168 can be positioned at a height of about 4 feet above the ground during the formation of the first half of the stack of trays (e.g., about 14 trays 190). After half of the stack has been formed, the loading conveyor 168 can be lowered such that the top of the stack is at about 4 feet to allow for formation of the second half of the stack. Because the stacking and loading of the trays 190 will be performed at a height of at least 4 feet above the ground, the vertical actuator 100 is mounted on a raised base 118 having a height of about 4 feet. With such an arrangement, the vertical actuator 100 need only have a vertical travel capability of about 3.5 feet.

The utilization of vertically-adjustable loading conveyors can also be utilized to incrementally maintain the top of a stack of trays at a height approximately even with the pick-up area 68 near the top of the inclined troughs 42. That is, every time an empty tray 190 is placed onto the stack of full trays, the loading conveyor 168 can be lowered (e.g., by a distance equal to the height of a tray) to maintain the top-most tray 190 level with the pick-up area 68. It can be appreciated that such incremental vertical movement of the loading conveyor 168 improves the efficiency of the overall process by decreasing the distance the pick-up head 94 must travel between the pick-up areas 68 and the loading areas.

Referring now to FIGS. 11–14, the pick-up head 94 includes an interface plate 120 for mounting to the fourth rotary actuator 114 of the transfer mechanism 96. A base portion 122 is secured to the interface plate 120 and provides a structure to which the other components of the pick-up head 94 are mounted. Referring to FIGS. 11–12, four bladder supports 124 extend downwardly from the base portion 122 and provide a means for supporting bladders 126 on a lower portion thereof. The bladder supports 124 extend longitudinally substantially from one end of the base portion 122 to the other end and are laterally spaced from each other by a distance sufficient to enable a stick 30 of container ends to be inserted therebetween. In the described embodiment, the bladder Supports 124 are about 45 inches long and are spaced from each other by a gap of about 2.8 inches.

Figure 11B:
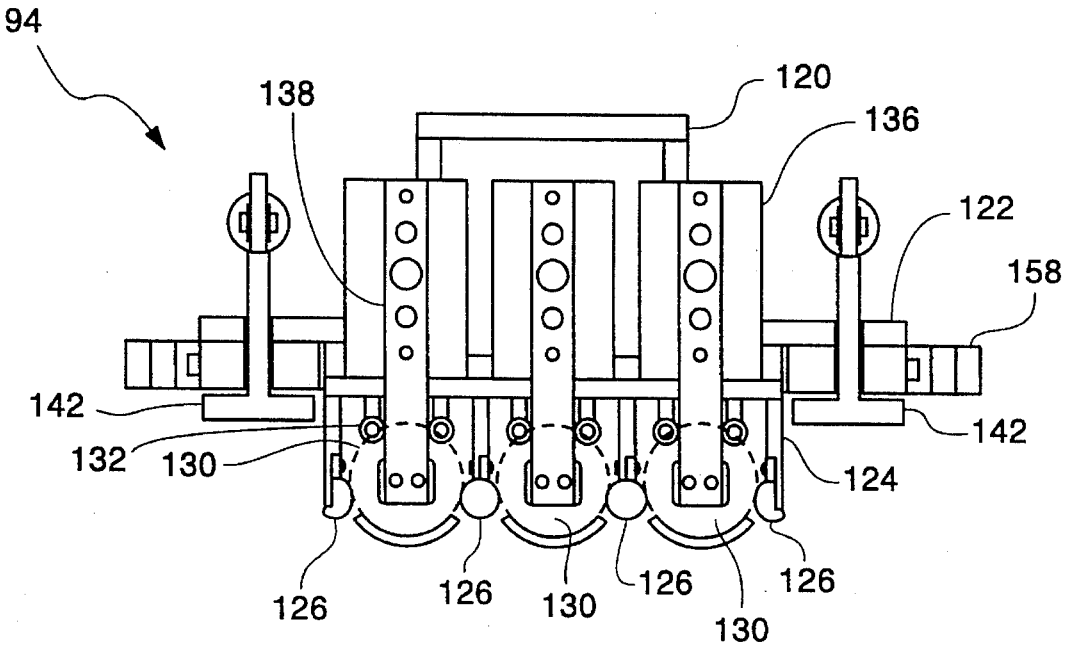
FIG. 11*b* is an end view of FIG. 11*a* with the bladders expanded.

Inflatable butyl nylon bladders 126 are appropriately secured to the lower end of each bladder support 124 and are operatively connected to a source of compressed air (not shown) via valves (not shown) and air lines 128. The valves are selectively moveable between an exhaust position, wherein compressed air is exhausted from the bladders 126 to put them in a collapsed condition (FIG. 11*a*), and an intake position, wherein compressed air is provided to the bladders 126 to put them in an expanded condition (FIG. 11*b*). The four bladders 126 (and corresponding bladder supports 124) define three engagement areas 130 therebetween for engaging sticks 30. The bladders 126 are designed such that the space between them is greater than the diameter of a stick 30 when the bladders 126 are collapsed, and the space between them is less than the diameter of a stick 30 when the bladders 126 are expanded. Such an arrangement allows three sticks 30 to be engaged by the pick-up head 94 by appropriately positioning three sticks 30 in the defined engagement areas 130 with the bladders 126 collapsed, and subsequently expanding the bladders 126 to retain the sticks 30 within the engagement areas 130.

In order to provide support to the upper portion of the sticks 30 engaged by the pick-up head, the pick-up head 94 is further provided with top supports 132 positioned above each engagement area 130. More specifically, two top supports 132 are positioned above each engagement area 130 and extend the full longitudinal extent thereof. Such top supports 132 are designed to prevent upward deflection of a stick 30 while the stick 30 is being engaged by the pick-up head. The utilization of such top supports 132 for supporting the top of the sticks 30 is especially beneficial when the sticks 30 will be compressed by the pick-up head, as is the case with the present embodiment which is described below in more detail. The top supports 132 preferably comprise a rigid material, such as aluminum, but may instead comprise a flexible material such as a hardened rubber to protect the edges of the container ends.

It is well-known in the container end processing field that a loose stick 30, having a first length $L_1$, can be compressed to a second length $L_2$ shorter than the first length $L_1$. When loading sticks 30 into channels of a tray, it may be desirable to compress the sticks 30 to a shorter length so that a larger number of container ends can be placed into each channel. In this regard, referring to FIGS. 12*a*–12*b*, the pick-up head 94 of the described embodiment includes a compression device 134 for supplying axial compressive force to each of the sticks 30 located within the defined engagement areas 130. The compression device 134 generally includes a compression cylinder 136 mounted to the base portion 122 above each end of each of the three engagement areas 130. That is, three compression cylinders 136 are mounted on each end of the base portion 122 above and between the bladder supports 124. Six compression clamps 138 are operatively connected to each of the six compression cylinders 136. The clamps extend downwardly from the cylinders such that at least a portion of each clamp is in alignment with an engagement area 130. As such, each engagement area 130 is further defined by a compression clamp 138 on each end thereof.

Figure 12A:
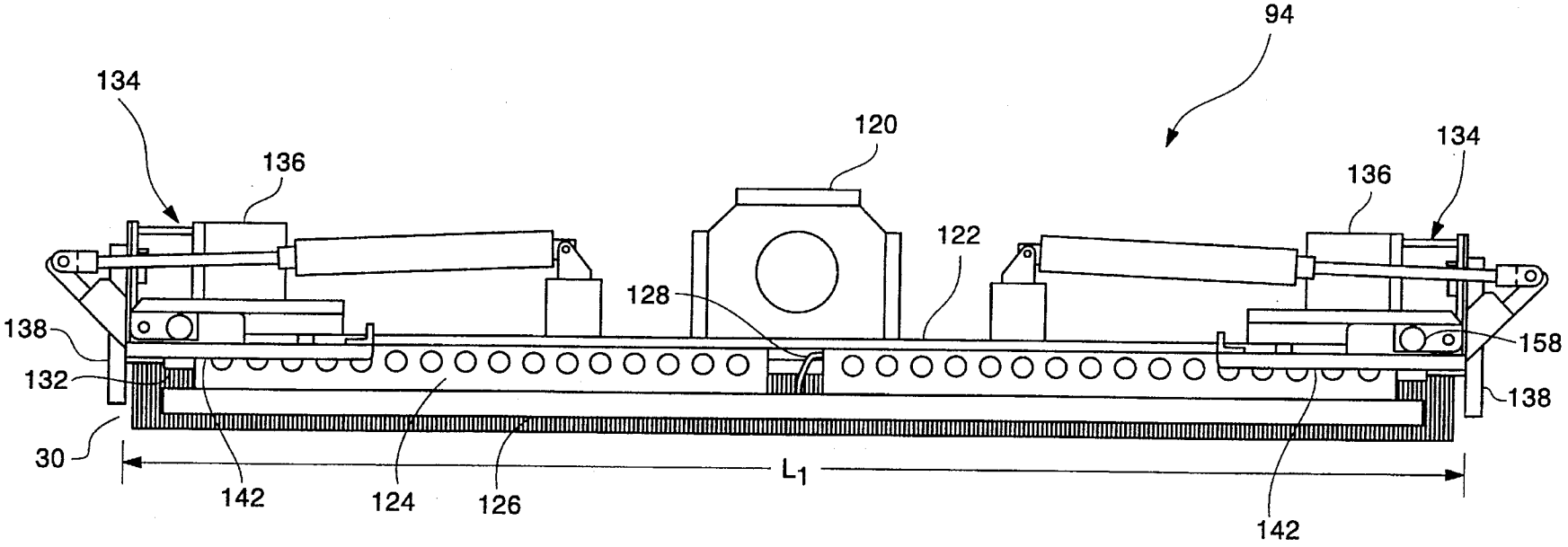
FIG. 12*a* is a side view of the pick-up and a stick of container ends with the end clamps in the released condition.
Figure 12B:
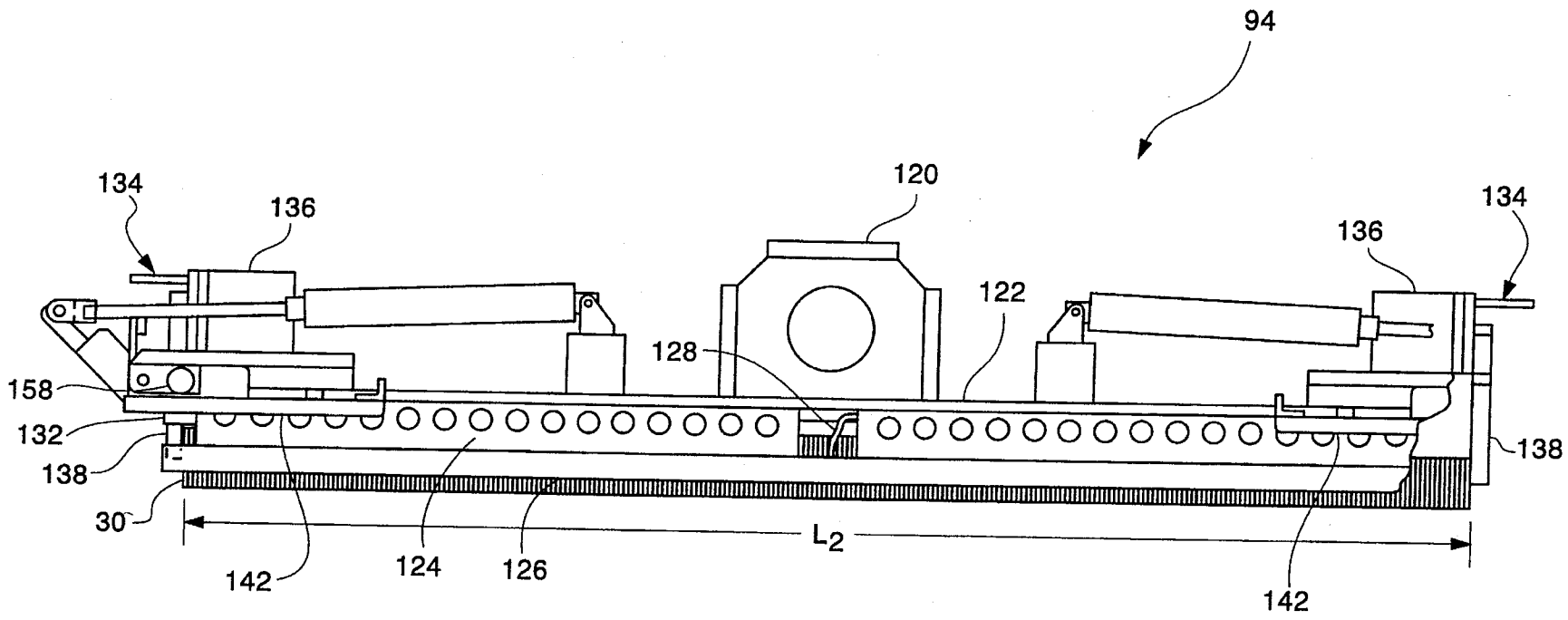
FIG. 12*b* is the side view of FIG. 12*a* with the end clamps in the compressed condition.

The compression clamps 138 are operatively movable by the compression cylinders 136 between a released condition, wherein the clamps are moved longitudinally outward from the center of the pick-up head 94 (FIG. 12*a*), and a compressed condition, wherein the compression clamps 138 are moved longitudinally inward toward the center of the pick-up head 94 (FIG. 12*b*). The range of motion and positioning of the compression clamps 138 is designed such that, when the clamps are in the released condition, the longitudinal distance between opposing compressing clamps is slightly greater than the length of an uncompressed, or partially compressed, stick 30. In the present embodiment, such distance is between about 48 and 50 inches. When the compression clamps 138 are in the compressed condition, the longitudinal distance between opposing end clamps is approximately equal to, or slightly less than, the length of a channel of a tray 190 into which the sticks 30 will be deposited. In the present embodiment, the channels are about 45.5 inches long. As such, each end clamp must be capable of moving at least about 2.0 inches, and preferably has a travel of about 2.5 inches. Such an arrangement allows the pick-up head 94 to be placed over an uncompressed stick 30 with the clamps in the released condition and allows the clamps to be subsequently actuated to the compressed condition to compress the stick 30 therebetween. The bladders 126 can subsequently be expanded to engage the stick 30 and the compressed stick 30 can then be positioned into a channel of a tray 190 and deposited therein by releasing the compression clamps 138 and collapsing the bladders 126.

In some instances, adjacent sticks 30 may be of different lengths. In this regard, the provision of separate and independent compression clamps 138 for each of the defined engagement areas 130 is advantageous in that it can accommodate sticks 30 of variable lengths. More specifically, since adjacent clamps are not mechanically fixed to each other, they can move independently to adjust to the appropriate position for the particular stick 30 being engaged. As such, each stick 30 will be securely engaged even though stick 30 length may vary slightly.

Figure 15A:
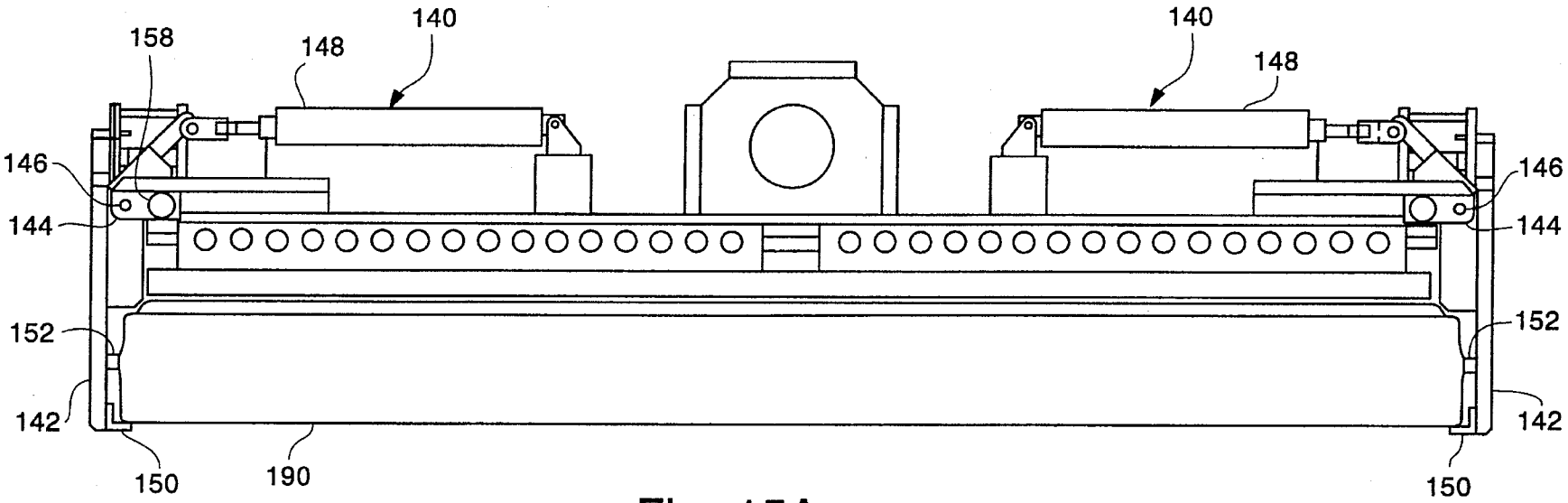
FIG. 15*a* is a side view of the pick-up head showing the tray lift members in the engaged position.
Figure 15B:
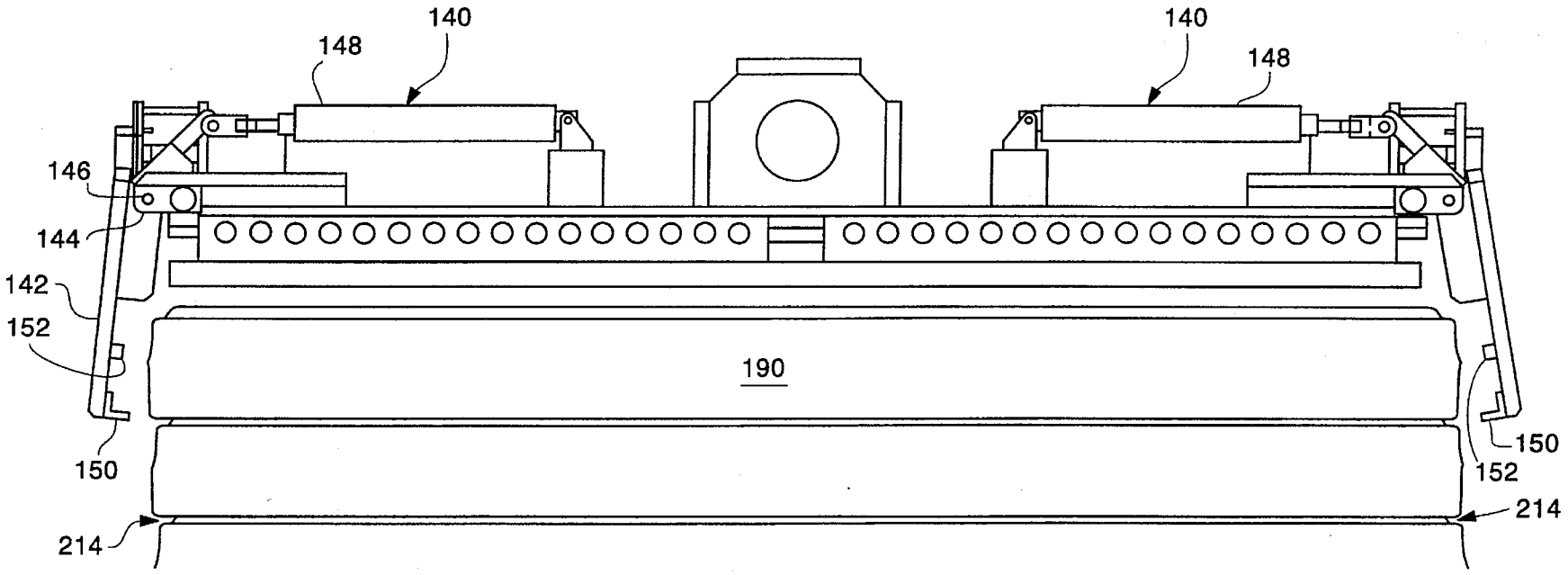
FIG. 15*b* is the side view of FIG. 15*a* with the tray lift members in the released condition, thereby depositing an empty tray onto a stack of trays.

As noted briefly above, the pick-up head 94 of the described embodiment is also designed to engage an empty tray 190 from a stack of empty trays located at an empty tray area 154, and transport the tray 190 to one of the loading areas where it is stacked on a tray 190 which has been filled with container ends. In this regard, referring to FIGS. 15–16, the pick-up head 94 of the described embodiment includes a tray engaging device 140 for selectively engaging and disengaging empty trays 190. The tray engaging device 140 includes four tray lift members 142 pivotably mounted to the base portion 122 at each corner thereof. For example, in the illustrated embodiment, the tray lift members 142 are positioned between yoke members 144 and are secured thereto utilizing pins 146. Each tray lift member 142 is operatively connected to a lift cylinder 148 for movement between an engaged condition, wherein a tray 190 may be engaged by the tray lift members 142 (FIG. 15*a*), and a disengaged condition, wherein a tray 190 may be released by the tray lift members 142 (FIG. 15*b*). The tray lift members 142 are further movable by the lift cylinders 148 to a retracted condition, as shown in FIGS. 11–13, wherein the tray lift members 142 are folded parallel to the base portion 122 so they do not interfere with the engagement and transport of sticks 30 from the pick-up area 68 to the loading area 92.

Figure 16:
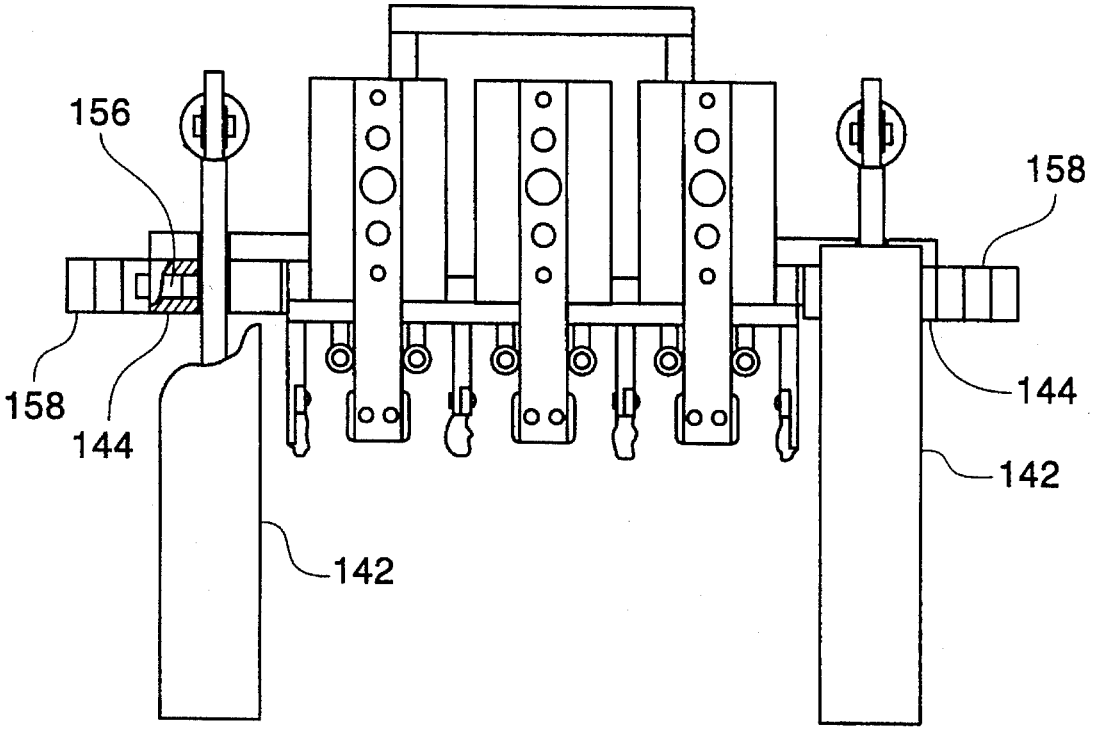
FIG. 16 is an end view of the pick-up head showing the tray lift members in the engaged position.

In order to prevent excessive force being applied to the trays 190 by the tray lift members 142 during engagement thereof, movement of the tray lift members 142 is limited by lock pins 156, as shown in FIG. 16. More specifically, a lock pin 156 is positioned adjacent each of the four yoke members 144 and is moveable between a locked position and an unlocked position by means of one of four lock cylinders 158 (e.g., pneumatic cylinders). In the locked position, each lock pin 156 is inserted laterally into the space between the corresponding yoke member 144 such that the lock pin 156 acts to stop the corresponding tray lift member 142 from moving inward (i.e., toward the center of the pick-up head) beyond the engaged position (i.e., beyond substantially vertical, as shown in FIG. 15*a*). As such, the force of each tray lift member 142 is substantially counteracted by each lock pin 156, rather than by the tray 190, thus reducing the force on the tray 190. When the tray lift members 142 are to be moved to the retracted position (depicted in FIGS. 11–13), each lock cylinder 158 is actuated to move the lock pins 156 out of the space between the corresponding yoke member 144 (i.e., to the unlocked position) such that the tray lift members 142 are no longer stopped from moving beyond the vertical position.

Each tray lift member 142 is provided with a lift finger 150, extending inwardly from a lower portion thereof, for engaging a tray 190 at an appropriate location. For example, the trays 190 shown in FIGS. 18–21 are designed such that a gap 214 exists between adjacent trays 190 when they are stacked, as shown in FIG. 15*b*. Such gap 214 provides a suitable location for insertion of the lift fingers 150 to allow for engagement of the tray 190 by the pick-up head 94.

Each tray lift member 142 is further provided with a lift boss 152, extending inwardly from the tray lift member 142 above the lift finger 150, for cushioning tray engagement and for inhibiting lateral sliding movement of the engaged tray 190 relative to the tray lift members 142 while being transported from the empty tray area 154 to the loading area 92. More specifically, the lift bosses 152 of the described embodiment comprise an elastomeric material, such as polyurethane, and are appropriately positioned such that, when the lift fingers 150 are inserted into the gap 214 between adjacent trays 190 to engage an empty tray, the lift bosses 152 engage the endwalls 194 of the tray. Such engagement provides a cushion between the tray lift members 142 and the tray, thereby reducing the likelihood of damage to the tray. Further, such engagement provides a relatively high friction contact area between the tray lift members 142 and the tray 190 to inhibit sliding of the tray 190 relative to the tray lift members 142.

As noted above, the trays 190 are stacked onto a pallet 34 positioned in the loading area 92. In this regard, referring to FIG. 1, the pallets 34 are supplied by a pallet dispenser 159 positioned adjacent the loading area 92. The pallet dispenser 159 is appropriately interconnected with the control means such that the pallet dispenser 159 will provide a pallet 34 to the loading area 92 at the appropriate time (e.g., when there is no pallet present in the loading area 92). Such a pallet dispenser can be an ordinary dispenser obtainable from, for example, Goldco Pallet Dispensing Co.

Figure 17:
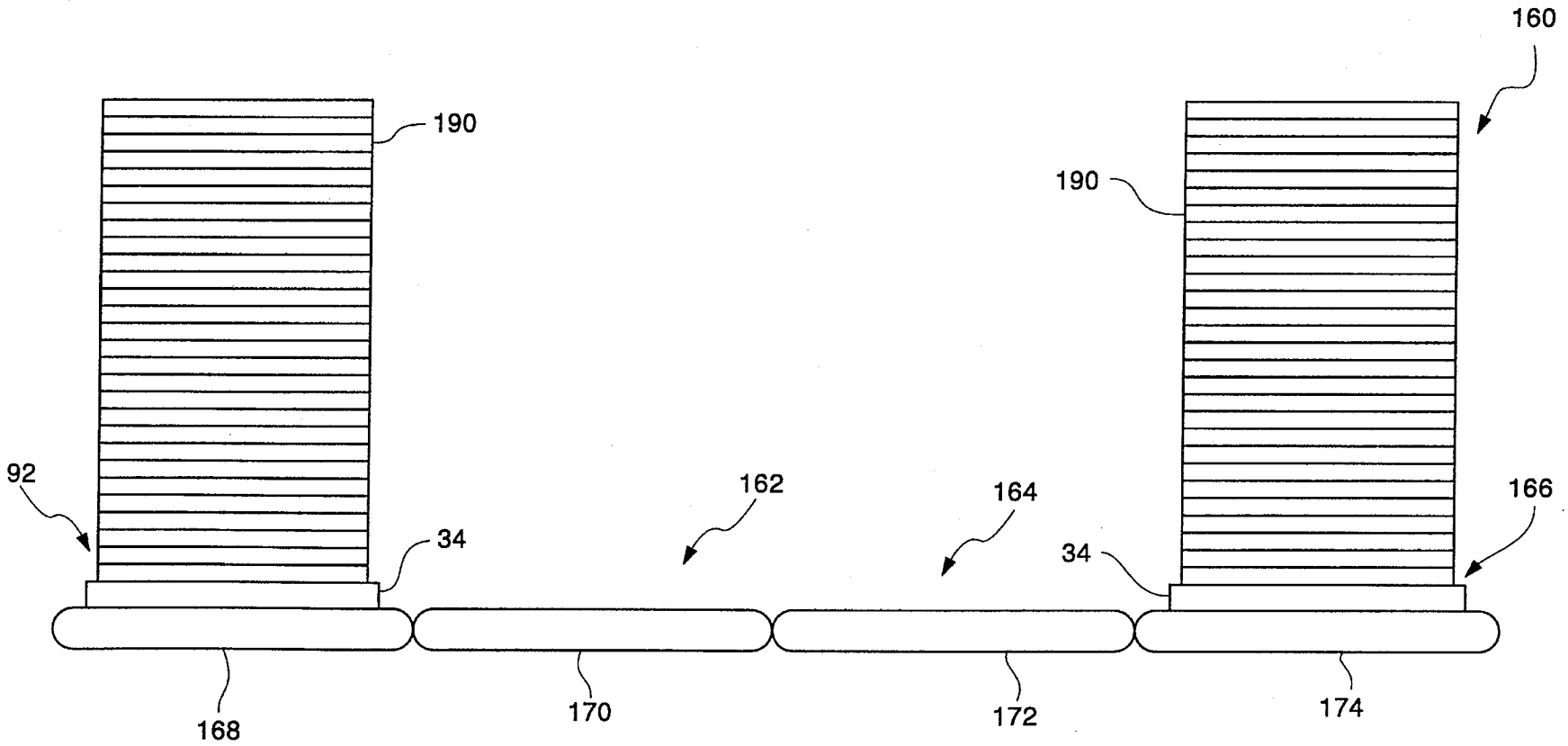
FIG. 17 is an elevation view of the discharge subassembly taken along line 17—17 in FIG. 1.

Referring now to FIGS. 1 and 17, the discharge subassembly 160 of the described embodiment provides a means whereby a stack of filled trays (e.g., positioned on a pallet 34 provided by the pallet dispenser 159) can be transferred from the loading area 92 to a discharge area 166. When positioned in the discharge area 166, the stack of trays can be engaged by an appropriate device and transported to a desired location. For example, the pallet 34 upon which the trays 190 are positioned can be lifted by a forklift and positioned into a transport vehicle for shipment to a customer. Alternatively, further automated means may be provided for transporting the stack of trays to a desired location.

The discharge subassembly 160 generally comprises a plurality of conveyors defining a loading area 92, one or more staging areas, and a discharge area 166. The conveyors of the illustrated embodiment are powered chain conveyors which are operatively connected to the control means for control purposes. In the illustrated embodiment, the conveyors comprise a loading conveyor 168, a first staging conveyor 170, a second staging conveyor 172, and a discharge conveyor 174. The conveyors are positioned adjacent each other such that a stack of trays may be conveyed from the loading area 92 to a first staging area 162, from the first staging area 162 to a second staging area 164, and from the second staging area 164 to the discharge area 166. It should be appreciated that one or more of the conveyors could comprise an inclined roller conveyor or other type of transport device for transporting a stack of trays from one area to another.

The discharge subassembly 160 further comprises sensors positioned at strategic locations for determining the position of stacks of trays. A discharge sensor 176 is appropriately positioned to detect the presence of a stack of trays in the discharge area 166. Similarly, first and second staging sensors 178,180 are appropriately positioned adjacent the first and second staging areas 162,164 for determining the presence of stacks of trays in the first and second areas 162,164, respectively. Each sensor is operatively connected to the control means such that the control means may utilize information received from the sensors for controlling the flow of work product through the discharge subassembly 160. For example, if the sensors indicate that a stack of trays is present in each of the first staging area 162, the second staging area 164, and the discharge area 166, the control means may deactivate the tray loading subassembly 90 when a full stack of trays is formed in the loading area 92. Under such circumstances, the control means will also prevent the transport of a stack of trays along the conveyor path of the discharge subassembly 160. Such a deactivating mechanism is beneficial in that it prevents stacks of trays from running into other stacks of trays and further ensures that the tray loading subassembly 90 does not attempt to create a stack of trays higher than the maximum desired height. The discharge sensor 176 can also be used as an indication that a stack of trays is ready to be removed from the discharge area 166 (e.g., by a forklift). Additionally, the respective sensors can be used to control the flow of work product through the discharge subassembly 160. For example, utilizing signals from the sensors, the control means can monitor the location of stacks of trays and control the movement of the stacks from one area to another.

If desired, the palletizing assembly may further include a strapping device (not shown) and/or a wrapping device (not shown) positioned adjacent the discharge subassembly 160. For example, a strapping device may be positioned adjacent the first or second staging areas 162,164 to provide each stack of trays with one or more securing straps to hold each stack to the respective pallet 34. Furthermore, a wrapping device may be provided in the first or second staging areas 162,164 to wrap each stack with a suitable wrap, such as plastic wrap, to further protect the container ends from contamination. As noted above, however, such wrapping of the stacks may be unnecessary due to the contaminant barrier design of the trays 190.

The tray 190 utilized by the present embodiment is illustrated in FIGS. 18–21. The tray 190 has a generally rectangular configuration defined by two sidewalls 192 and two endwalls 194. Twelve longitudinal top channels 196 are defined in the upper half of the tray 190 and extend substantially from one endwall 194 to the other endwall 194. In the present embodiment, the top channels 196 are about 45.5 inches long, which is sufficient to accommodate between about 550 and 600 converted container ends in the compressed condition. In order to accommodate insertion of the bladders 126 and bladder supports 124 of the pick-up head 94 between sticks 30 within a tray, the center axes of the respective top channels 196 are laterally spaced from each other by a distance slightly larger than the diameter of a stick 30. Such lateral spacing creates intermediate portions 198 of the tray. In the illustrated embodiment, the top channels 196 are laterally spaced by about 3.215 inches.

Figure 13A:
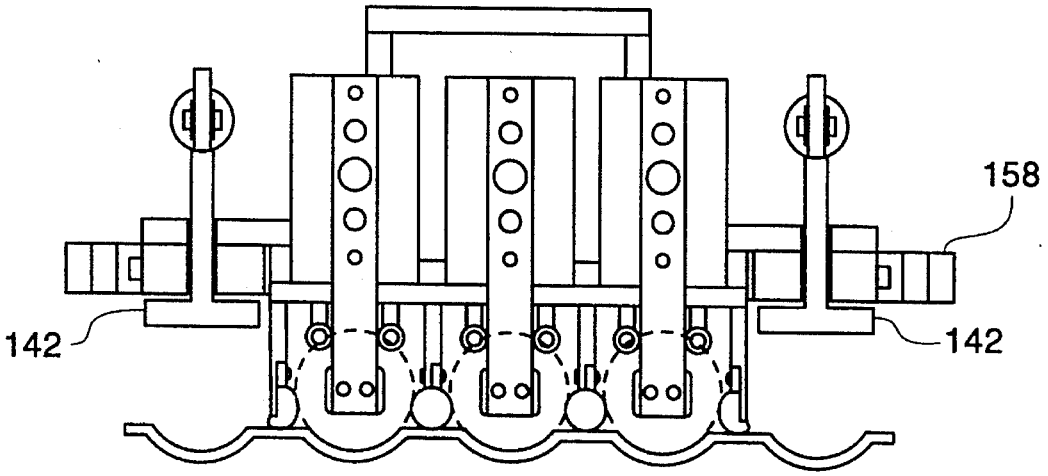
FIG. 13*a* is an end view of the pick-up head as three sticks of container ends are being positioned in the channels of a tray with the bladders expanded.
Figure 13B:
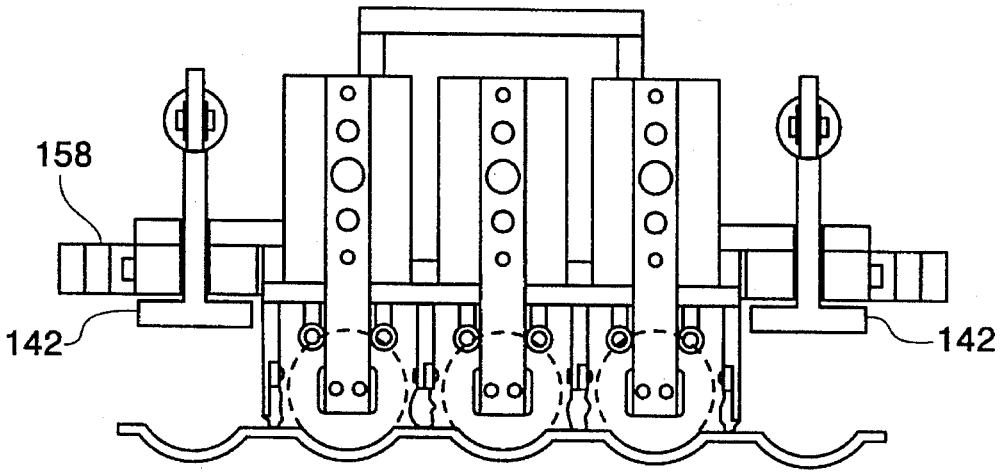
FIG. 13*b* is the end view of FIG. 13*a* with the bladders collapsed and the sticks deposited in the channels of the tray.
Figure 14:
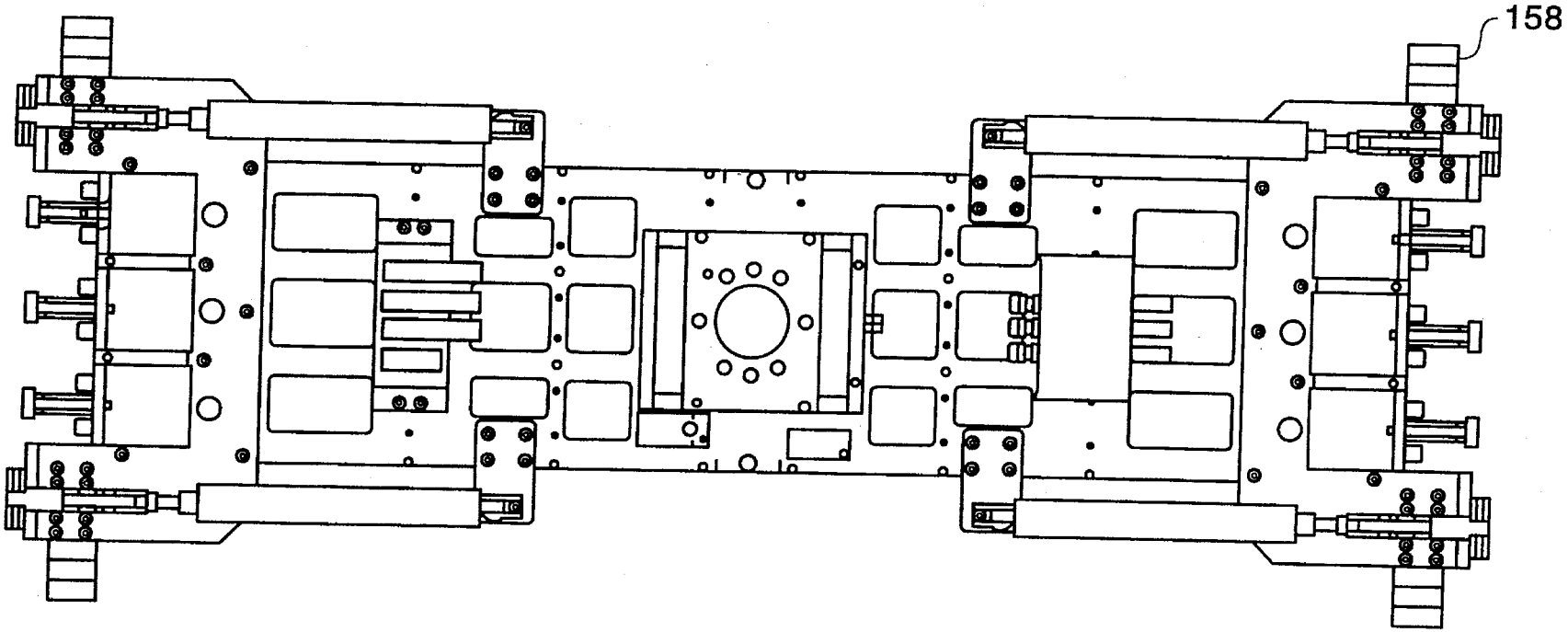
FIG. 14 is a top view of the pick-up head.
Figure 19:
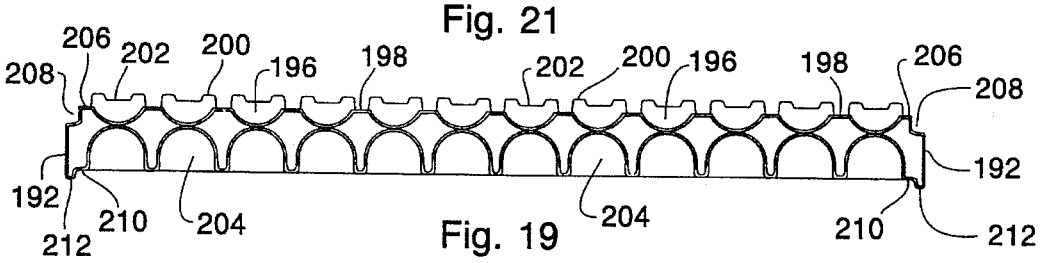
FIG. 19 is a section view of the tray taken along line 19—19 in FIG. 18.
Figure 18:
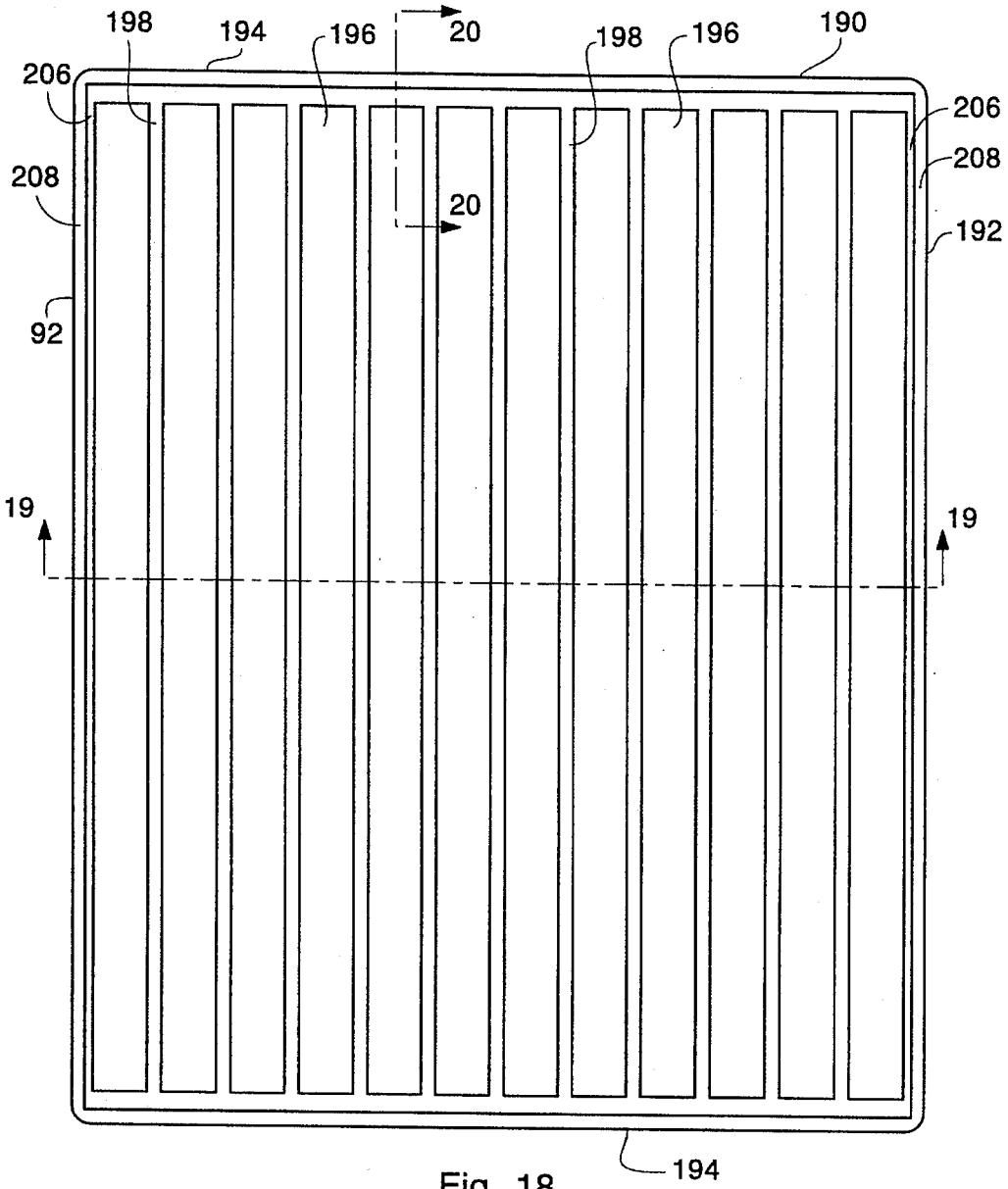
FIG. 18 is a top view of a tray used in the described embodiment.

As best shown in FIGS. 13*a*–b and 19, the top channels 196 are shaped to receive a stick 30 therein, yet allow for engagement of the stick 30 by the pick-up head. In this regard, the channels only engage a portion of the lower half of the stick 30. That is, the channels are not deep enough to completely engulf the lower half of the sticks 30. This configuration allows for insertion of the bladders 126 between adjacent sticks 30 and positioning of the bladders 126 slightly below the centerline of the sticks 30, as shown in FIG. 13*a*–b. Such positioning below the centerline of the sticks 30 allows the bladders 126 to engage the sticks 30 below the widest portion of the sticks 30, thereby providing engagement of the sticks 30 by the pick-up head 94. In the described embodiment, the channels are about 0.688 inches deep, while the diameter of a stick 30 is about 2.550 inches.

Figure 20:
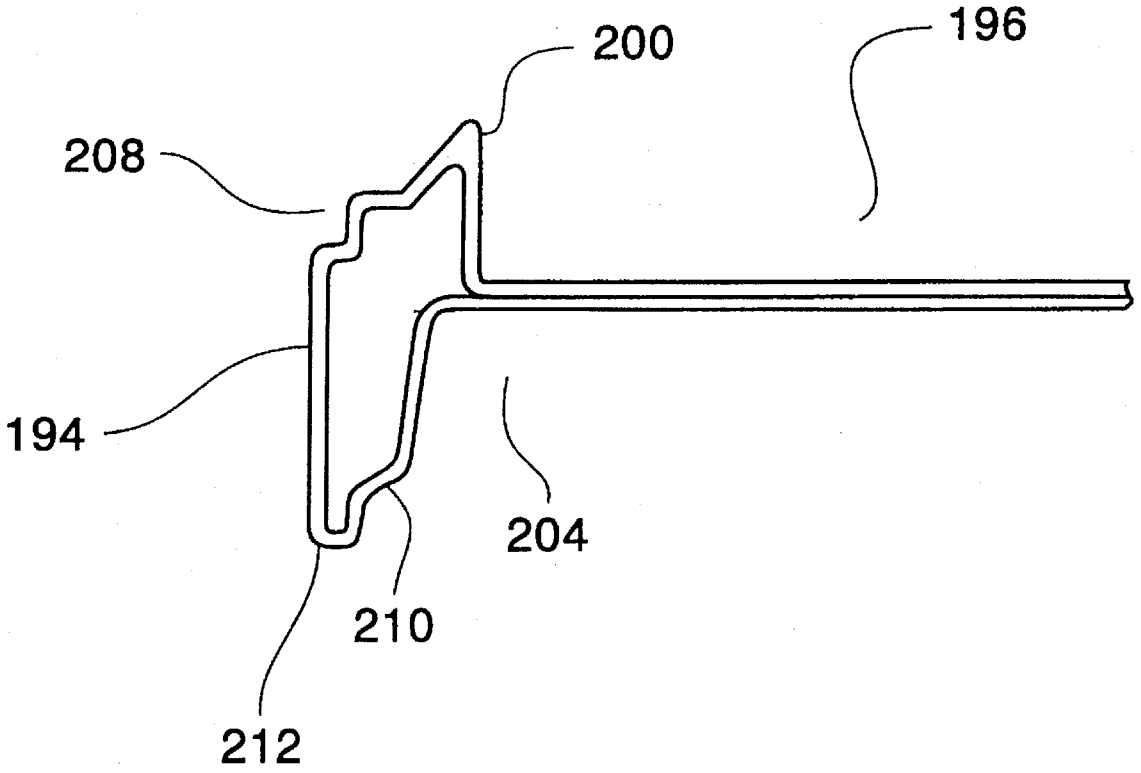
FIG. 20 is a section view of the tray taken along line 20—20 in FIG. 18.

Referring to FIGS. 19 and 20, the illustrated tray 190 further includes raised end supports 200 positioned on both ends of each channel for providing support to each end of the sticks 30 positioned in the channels. The end supports 200 are raised above the bottom of the channel by a distance approximately equal to the radius of the container ends desired to be inserted therein. That is, the top of each end support 200 will approximately engage the stick 30 at a point about half way up the stick 30. Provision of such end supports 200 substantially prevents the container ends on each end of the stick 30 from "fanning" due to the compressive state of the stick 30. As can further be seen from FIG. 19, each end support 200 has a recess 202 cut therein for allowing the end clamps of the pick-up head 94 to travel therethrough. As a result, each end support 200 engages the stick 30 at its midportion (i.e., half way up the end) on an outer periphery thereof.

In order to accommodate the stacking of trays 190 filled with container ends, the trays 190 further include bottom channels 204 in the lower half thereof. The bottom channels 204 substantially correspond in dimensions to the top channels 196 and are positioned to be in alignment therewith. That is, the bottom channels 204 are located in opposing relation to the top channels 196 on the upper half of the tray. The major difference between the bottom channels 204 and the top channels 196 is that the bottom channels 204 are significantly deeper than the top channels 196 to allow for a substantially greater portion of the container ends to be inserted therein. The bottom channels 204 are of such a depth that they completely engulf the portion of the stick 30 which is not engulfed by the tray 190 immediately below it. In the illustrated embodiment, the top channels 196 are about 0.688 inches deep, the bottom channels 204 are about 1.938 inches deep, and the sticks 30 have a diameter of about 2.550 inches. Such a tray configuration provides substantial isolation of the container ends from the environment and further allows the intermediate portions 198 between the channels of adjacent trays 190 to contact one another to provide further support to the trays 190 when stacked.

Figure 21:
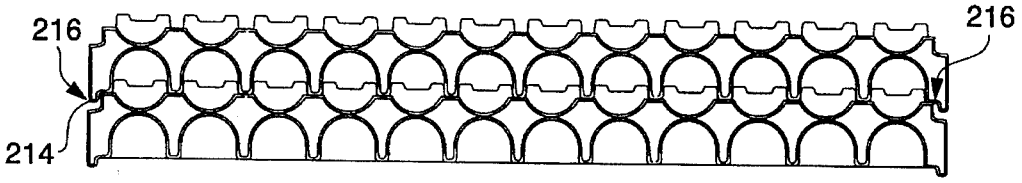
FIG. 21 is a section view of two trays in stacked relation.

The upper marginal edge 206 of the sidewalls 192 and endwalls 194 includes a recessed groove 208 extending around the full perimeter thereof. Correspondingly, the lower marginal edge 210 of the sidewalls 192 and endwalls 194 includes a depending lip portion 212 extending around the full perimeter thereof. The dimensions of the groove 208 and the lip portion 212 are such that, when a tray 190 is stacked onto another tray, the lip portion 212 slides into the groove 208, thereby providing desirable lateral securement of adjacent trays 190 for stacking purposes and further providing a barrier to entrance of contaminants into the channels of the trays 190. As shown in FIGS. 19–21, the vertical length of the lip portion 212 is slightly less than the vertical length of the groove 208. With such a configuration, a gap 214 is formed between adjacently stacked trays 190 (FIG. 21). For example, in the described embodiment, the lip portion 212 is about 0.250 inches long vertically and the groove 208 is about 0.375 inches long vertically, thereby providing a 0.125 inch gap 214 therebetween. As noted above, the gap 214 provides a suitable location for insertion of the lift fingers 150 to allow for engagement of the tray 190 by the pick-up head 94.

It should be appreciated that the relative locations of the lip portion 212 and the groove 208 could be reversed. That is, the lip portion 212 could extend upwardly from the upper marginal edge 206 of the sidewalls 192 and endwalls 194, while the groove 208 could be positioned into the lower marginal edge 210 of the sidewalls 192 and endwalls 194. However, the illustrated configuration is preferred because it substantially prevents liquids, which may contact the sidewalls 192 of the trays 190, from entering the channels. That is, due to the positioning of the depending lip portion 212 as shown in FIG. 21, any liquid which may flow down the exterior of the sidewalls 192 of the trays 190 should not enter the channels of the trays 190 due to the vertically upward path 216 which the liquid would have to follow between the lip portion 212 and the groove 208. As such, the positioning of the lip portion 212 as illustrated substantially inhibits the entrance of liquids into the channels.

Having described the structure and operation of the individual subassemblies, the operation of the whole assembly will now be summarized from start to finish. In operation, one supply subassembly 40 receives three continuous arrays 28 from the first conversion press 24 and the other supply subassembly receives three continuous arrays 28 from the second conversion press 26. Each of the arrays 28 enters the respective counting device 46 in its own trough (FIG. 2*a*). When the counting device 46 has counted a predetermined number of container ends (corresponding to the number of container ends comprising a stick 30), the counting device 46 sends a signal to the control means. Upon receipt of the signal, the control means directs the separating actuator 54 to insert the separating finger 52 into the path of container ends to thereby separate a stick 30 from the continuous array 28. Subsequently, the control means activates the separating cylinder 56 to transport the stick 30 to the staging area 50 (FIG. 2*b*).

If a stick 30 is not present in the respective pick-up area 68, the control means will direct the shuttle cylinder 66 to position the shuttle actuator 64 and shuttle finger 62 adjacent the downstream end 70 of the previously-separated stick 30. Once properly positioned, the control means will direct the shuttle actuator 64 to insert the shuttle finger 62 through the slot in the trough 42 and into the path of container ends (FIG. 2*b*). At this point, the separating finger 52 is retracted and returned to its initial position adjacent the counting device 46 in order to separate and transport the subsequent stick 30. Once the separating finger 52 is removed, the shuttle finger 62 provides the support for the stick 30 (FIG. 2*c*). The control means subsequently directs the shuttle cylinder 66 to transport the stick 30 to the pick-up area 68 (FIG. 2*d*), where the stick 30 will be held until it is engaged by the pick-up head 94. Once the stick 30 is engaged by the pick-up head 94, the shuttle 60 can be returned to its initial position to await the transport of another stick 30 to the staging area 50.

As noted previously, the control means utilizes signals from the respective sensors (i.e., the separating sensor 78, the staging sensor 76, and the pick-up sensor 74) to control the movement of sticks 30 within the supply subassembly 40, and further to provide the tray loading subassembly 90 with an indication that a stick 30 is ready to be transferred from the pick-up area 68. Furthermore, the control means can utilize the respective sensors as an emergency deactivating means whereby the upstream conversion press 24 may be selectively deactivated to avoid collisions between the continuous array 28 and counted sticks 30.

Figure 11A:
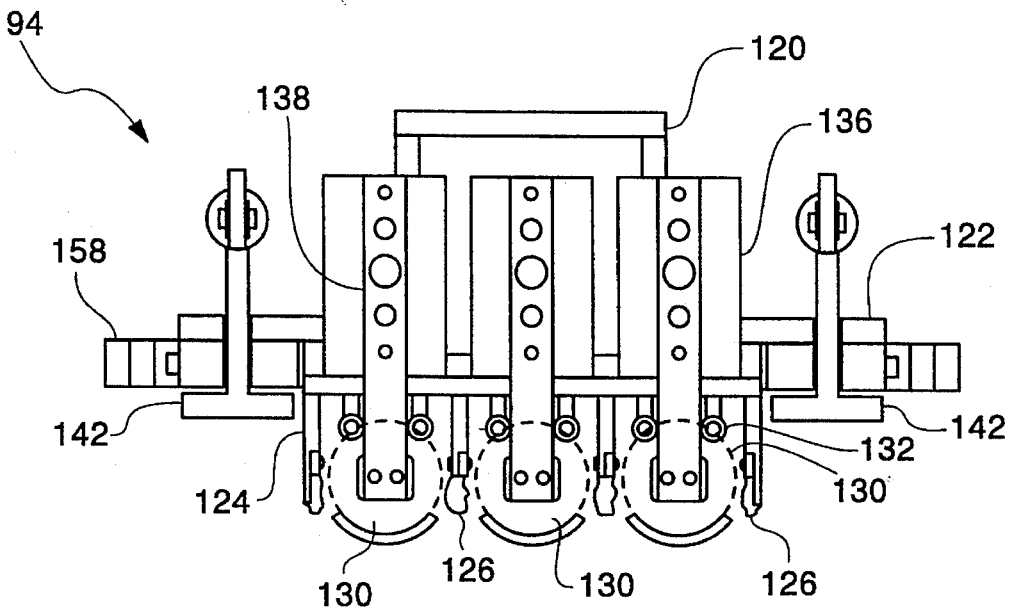
FIG. 11*a* is an end view of the pick-up head with the bladders collapsed.

When all three pick-up sensors 74 of at least one of the supply subassemblies indicates that three sticks 30 are appropriately positioned in the respective pick-up area 68, the tray loading subassembly 90 will be instructed to engage and transport the sticks 30 to the corresponding loading area 92. In this regard, the transport mechanism positions the pick-up head 94 above the appropriate pick-up area 68. The fourth rotary actuator 114 is subsequently activated to tilt the pick-up head 94 to an angle which matches the inclination of the trough 42 in the pick-up area 68 (FIG. 2*d*). Subsequently, the transfer mechanism 96 lowers the pick-up head 94 into the pick-up area 68 until the deflated bladders 126 are appropriately positioned on opposing sides of each of the sticks 30 at a point slightly below the centerline of the sticks 30 (FIG. 11*a*). The six compression cylinders 136 are subsequently actuated to move the respective compression clamps 138 from the released condition to the compressed condition to axially compress the stick 30 from a first length $L_1$ to a second length $L_2$ (FIGS. 12*a* and 12*b*). The bladders 126 are subsequently expanded to engage the sticks 30 within the engagement areas 130 of the pick-up head (FIG. 11*b*). After engagement, the fourth rotary actuator 114 is actuated to rotate the pick-up head 94 back to the horizontal position (i.e., not tilted).

The transfer mechanism 96 then transfers the pick-up head 94 (and the three engaged sticks 30) from the pick-up-area 68 to a position immediately above three empty channels of a tray 190 in the loading area 92. The transfer mechanism 96 then lowers the pick-up head 94 until the sticks 30 are positioned within the empty channels (FIG. 13*a*). The compression clamps 138 are subsequently released and the bladders 126 collapsed (FIG. 13*b*) to deposit the three sticks 30 into the channels of the tray.

It should be noted, as stated above, that the sticks 30 from one side of the assembly (i.e., from one conversion press) will only be deposited in the loading area 92 on the same side of the assembly. By virtue of such an arrangement, container ends in the trays 190 in one loading area 92 will all have originated from the same conversion press. Such separation of container ends from different conversion presses can provide substantial advantages in the manufacturing process, as set forth in more detail above.

The transfer mechanism 96 of the described embodiment has the ability to perform ten "picks" (three sticks per pick) per minute. Given that two out of every ten picks will transfer an empty tray 190 and given that there are about 600 ends per stick 30, the transfer mechanism 96 can accommodate up to about 14,400 ends per minute. This capacity is more than enough to handle the approximately 4,000 ends per minute that are produced by two standard conversion presses.

The process of engaging sticks 30 in the pick-up area 68 and depositing the sticks 30 into channels of trays 190 positioned in the loading area 92 continues until the channels of the tray 190 are all filled with sticks 30. For example, in the illustrated embodiment, each tray 190 comprises twelve compartments. Therefore, the tray loading subassembly 90 will need to perform four complete cycles of engaging and depositing sticks 30 into the channels (three sticks 30 at a time) in order to fill the tray. It should be noted that the control means is capable of remembering which channels have been filled and which channels remain empty. Therefore, no special sensors are required in this respect.

Once the channels of a tray 190 are completely filled with sticks 30, the control means directs the pick-up head 94 to retrieve an empty tray 190 from the empty tray area 154 and to deposit the empty tray 190 onto the completely filled tray. In this regard, the control means directs the transfer mechanism 96 to position the pick-up head 94 above the stack of empty trays 190 in the empty tray area 154. The lift cylinders 148 are subsequently actuated to position the four tray lift members 142 from the retracted condition (FIGS. 11–13) to the disengaged condition with the lock pins 156 in the locked position. The pick-up head 94 is then lowered over the top-most empty tray 190 until the lift fingers 150 are approximately aligned with the gap 214 between the top-most tray 190 and the adjacent tray (FIG. 15*b*). The lift cylinders 148 are then actuated to move the tray lift members 142 from the disengaged condition to the engaged condition (FIG. 15*a*), wherein the lock pins 156 limit further inward movement of the tray lift members 142. Once a tray 190 is engaged, the transfer mechanism 96 is directed to transport the engaged tray 190 to a position immediately above the filled tray 190 in the loading area 92. The empty tray 190 is subsequently lowered onto the filled tray 190 and the tray lift members 142 are subsequently moved from the engaged condition to the disengaged condition to deposit the empty tray 190 onto the filled tray (generally illustrated in FIG. 15*b*). The lock pins 156 are subsequently moved to the unlocked position so that the tray lift members 142 can be moved back to the retracted condition to allow for further engagement of sticks 30 by the pick-up head.

The process of loading sticks 30 into trays 190 and stacking empty trays 190 onto filled ones continues until the desired stack of filled trays is formed. For example, in the illustrated embodiment, the desired stack of trays comprises about 27 trays. A stack of 27 trays has been found to provide desired packaging and loading benefits. In this regard, the first 14 trays are loaded and stacked with the loading conveyor 168 fully raised by the scissor mechanism 116 (shown at the left in FIG. 9). After about 14 trays have been stacked, the loading conveyor 168 is lowered to the ground to allow loading and stacking of the next 13 trays 190 (shown at the right in FIG. 9). Once the desired stack of filled trays has been formed, an empty tray 190 may be placed on top of the stack to cover the sticks 30 in the top-most filled tray 190 to protect such sticks 30 from contamination.

With the stack of filled trays positioned in the loading area 92, the discharge subassembly 160 can be utilized to transport the stack to the discharge area 166 (FIG. 17). In this regard, the loading conveyor 168 and the first staging conveyor 170 may be activated to transport the stack of trays from the loading area 92 to the first staging area 162. As noted above, strapping or wrapping operations may be performed in the first staging area 162. Subsequently, the first staging conveyor 170 and the second staging conveyor 172 may be activated to transport the stack of trays to the second staging area 164. Similar to the first staging area 162, strapping or wrapping operations may be performed in the second staging area 164. Finally, the second staging conveyor 172 and the discharge conveyor 174 may be activated to transport the stack of trays to the discharge area 166. At this point, the stack of trays is appropriately positioned to be removed from the discharge area 166 by an appropriate lift and transport means (e.g., a forklift).

The control means utilizes signals from sensors (i.e., the staging sensors 178,180 and the discharge sensor 176 shown in FIG. 1) to control movement of the stacks of trays within the discharge subassembly 160, and further to provide the appropriate transport means (e.g., a forklift) with an indication that a stack of trays is ready to be transferred from the discharge area 166. Further, the control means can utilize the respective sensors as an emergency deactivating means whereby the tray loading subassembly 90 may be selectively deactivated to prevent stacks of trays from running into other stacks of trays and further to ensure that the tray loading subassembly 90 does not attempt to create a stack of trays higher than the desired height.

Figure 22:
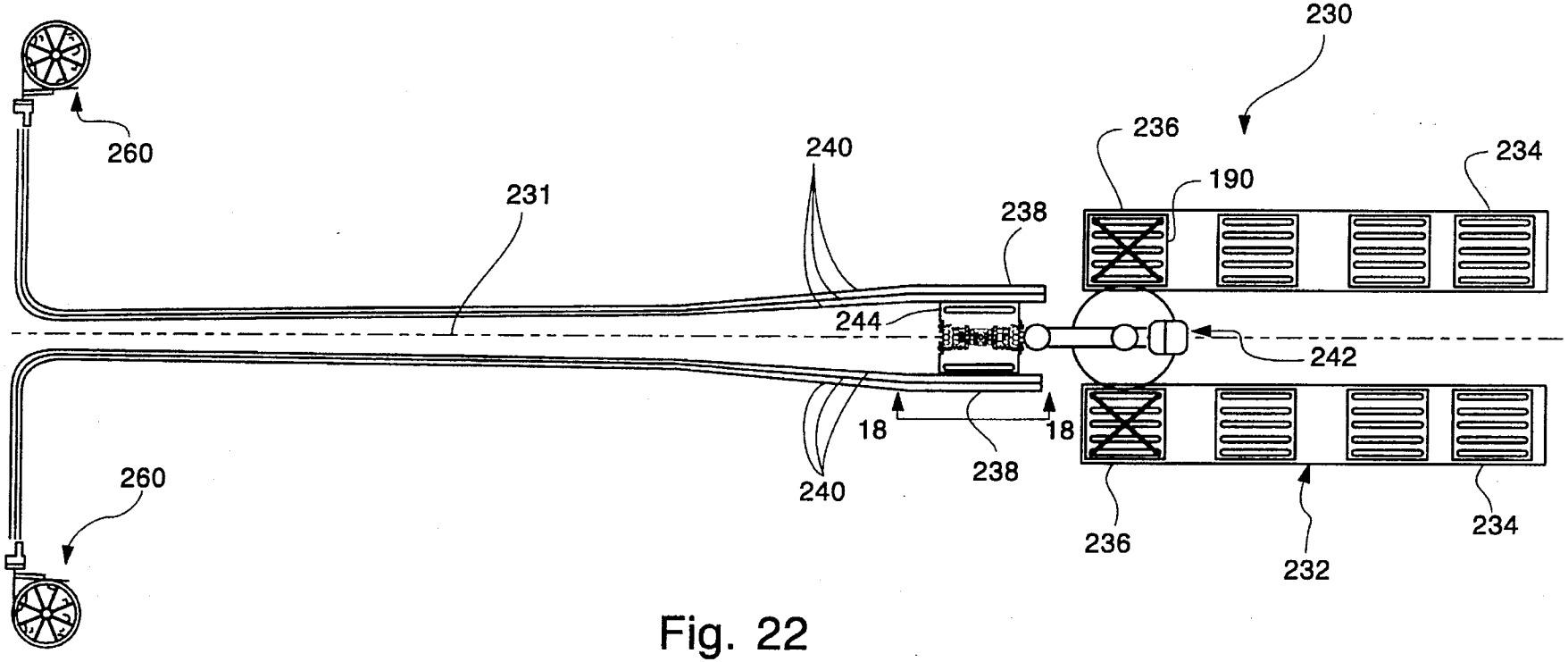
FIG. 22 is a plan view of a container end depalletizing assembly embodying features of the present invention.

Once the stacks of filled trays are removed from the discharge area and transported (e.g., via ground transport) to a filling location, it may be desirable to have an automated means for de-palletizing sticks from the trays 190. In this regard, such automated de-palletizing of container ends may be performed utilizing an apparatus substantially similar to the above-described apparatus for palletizing container ends into trays 190. Briefly, the end de-palletizing assembly 230 illustrated in FIGS. 22 and 23 is designed to receive multiple stacks of trays filled with container ends, unload the container ends from the trays 190, and place them into one or more troughs 240 which supply a container filling machine 260.

More specifically, a tray stack supply subassembly 232 is provided with stacks of filled trays (e.g., via a forklift) and transports the stacks of trays to a tray unloading area 236. The container ends in the filled trays are subsequently unloaded and placed into a plurality of deposit areas 238 in troughs 240 utilizing a tray unloading subassembly 242. When a tray 190 has been completely emptied, the tray unloading subassembly 242 engages the top-most empty tray 190 from the stack in the unloading area 236 and deposits it in an empty tray area 244. This process continues until a stack of filled trays has been completely unloaded, at which time the tray unloading subassembly 242 engages and moves the underlying pallet 34 from the tray unloading area 236 and stacks it in the empty tray area 244 along with the empty trays 190. The tray stack supply subassembly 232 subsequently transports a new stack of filled trays to the tray unloading area 236 for unloading.

As can be appreciated, the de-palletizing assembly 230 is similar to the palletizing assembly 20 except that it essentially functions in reverse. As such, the tray stack supply subassembly 232 of the de-palletizing assembly 230 can essentially be performed by the above-described discharge subassembly 160 of the palletizing assembly 20, with minor modifications. Similarly, the tray unloading subassembly 242 of the de-palletizing assembly 230 is essentially the same as the above-described tray loading subassembly 90 of the palletizing assembly 20. The major difference between the de-palletizing assembly 230 and the palletizing assembly 20 is that the de-palletizing assembly 230 does not include most of the moving parts of the supply subassembly 40 of the palletizing assembly 20, as described below in more detail.

Figure 23:
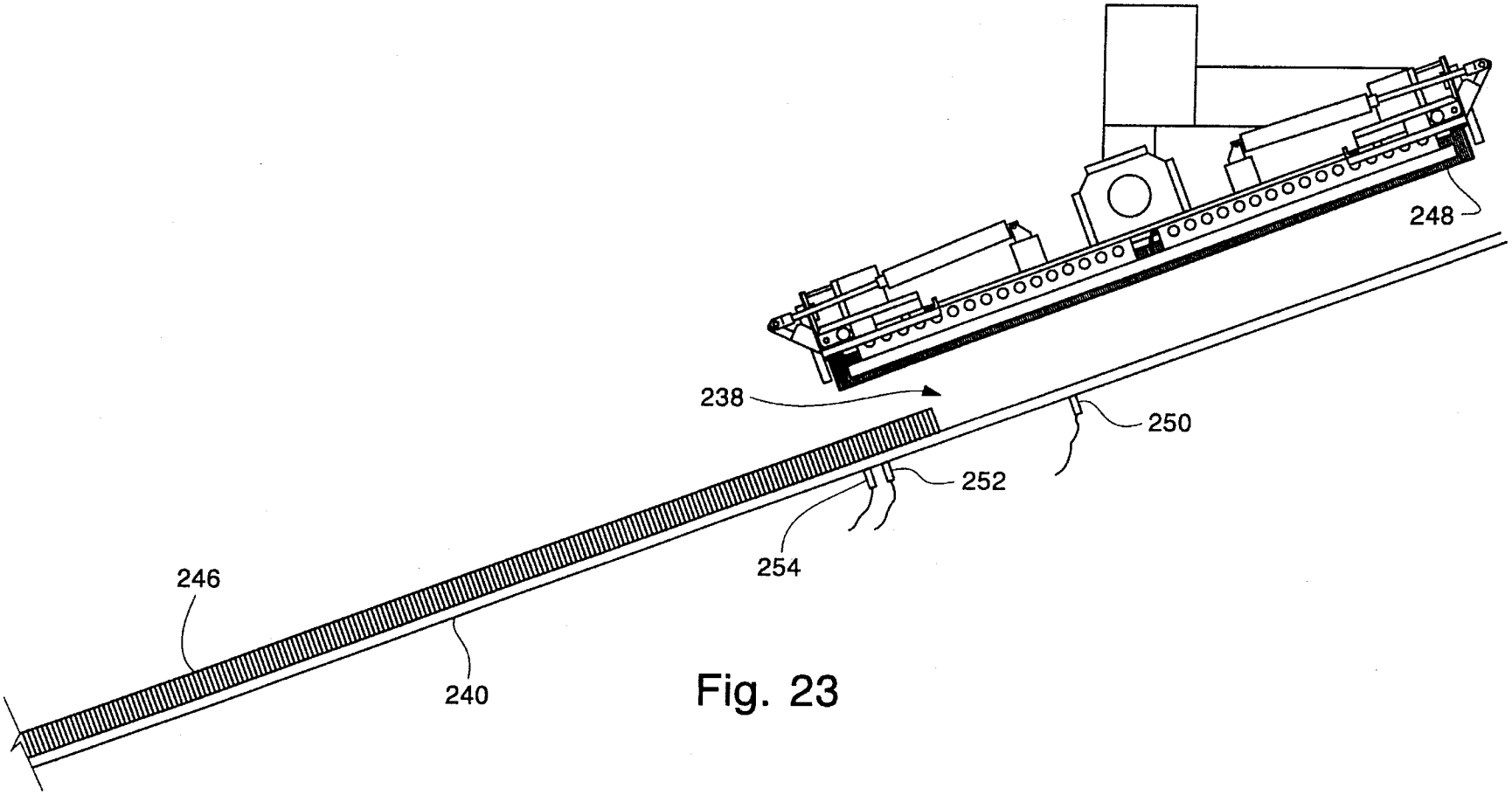
FIG. 23 is an elevation view of the depalletizing assembly taken along line 23—23 in FIG. 22.

Referring to FIG. 23, the trough 240 into which the sticks 248 are deposited in the de-palletizing assembly 230 can be of any appropriate configuration. In the described embodiment, the trough 240 is substantially identical to the above-described trough 42 of the supply subassembly 40 of the palletizing assembly 20 (i.e., substantially U-shaped).

The de-palletizing assembly 230 further includes a plurality of sensors to provide information regarding the relative positioning of the consolidated array 246 relative to the deposit area 238 into which sticks 248 are to be deposited. A warning sensor 250 is positioned in the deposit area 238, approximately one-third of the distance from the downstream end thereof, to provide an indication to the control means that a new stick 248 will soon be needed. A clearance sensor 252 is positioned just downstream of the deposit area 238 to indicate to the control means that a new stick 248 can be deposited into the deposit area 238. A shut-off sensor 254 is positioned a short distance downstream from the clearance sensor 252 and will direct the control means to deactivate the container filling machine 260. This prevents container ends on the downstream end of a subsequently-discharged stick 248 from falling over when the stick 248 is deposited in the deposit area 238.

In operation, a stack of filled trays is provided to the supply area 234 of the tray stack supply subassembly 232 by, for example, a forklift. The stack of filled trays is transported by the filled tray supply subassembly 232 over a set of conveyors to a tray unloading area 236. The filled tray supply subassembly 232 may comprise multiple staging areas so that a plurality of stacks of filled trays are available for supplying the tray unloading area 236. Furthermore, sensors (not shown) may be provided for controlling movement of stacks of filled trays between the supply area 234 and the tray unloading area 236, as described above with regard to the discharge subassembly 160 of the palletizing assembly 20.

Upon receipt of a signal from the warning sensor 250 indicating that a stick 248 will soon be required at the deposit area 238, the pick-up head 243 of the tray unloading subassembly 242 engages a plurality of sticks 248 from the top-most tray 190 in the tray unloading area 236 and positions the sticks 248 immediately above the deposit area 238 (FIG. 23) with the pick-up head 243 tilted to approximately the same angle as the trough 240 in the deposit area 238. When the continuous array 246 has cleared the clearance sensor 252, the tray unloading subassembly 242 will deposit the stick 248 into the deposit area 238. After depositing the stick, the pick-up head 243 will be rotated back to horizontal (i.e., not tilted) and positioned adjacent a tray unloading area 236 in preparation for the next cycle.

Because of the close proximity of the continuous array 246 to the deposit area 238, the downstream end of the stick 248 being deposited into the deposit area 238 will be supported by the continuous array 246 to thereby prevent container ends from falling over. If the continuous array 246 should travel beyond the shut-off sensor 254 before a new stick 248 is deposited in the deposit area 238, the control means will deactivate the downstream container filling machine 260 until a new stick 248 is deposited in the deposit area 238. Once the top-most tray 190 is completely unloaded, the tray unloading subassembly 242 will engage such tray 190 and move it to the empty tray area 244 so that the subsequent tray 190 may be unloaded.

It can be seen from FIG. 22 that, similar to the palletizing assembly 20, the de-palletizing assembly 230 is essentially a mirror image about a central longitudinal axis 231. In this regard, the de-palletizing assembly 230 supplies container ends to two separate container filling machines 260. As with the palletizing assembly 20, the de-palletizing assembly 230 maintains the container ends supplied on one side of the assembly separate from the container ends supplied on the other side of the assembly. With proper monitoring and control, the container ends supplied to one side of the assembly can be container ends which were all produced on the same conversion press. Such separation of container ends from different conversion presses can provide substantial advantages in the manufacturing process, as set forth in more detail above.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. An assembly for processing container ends received from at least two sources, said assembly comprising:

a pick-up area for receiving a plurality of container ends from a first source and second source, different from the first source;

a first loading area for accommodating a plurality of container ends and comprising a first tray;

a second loading area for accommodating a plurality of container ends and comprising a second tray, said first and second trays being positioned so as to be simultaneously accessible for receiving container ends; and a moving means for engaging container ends from the first source at said pick-up area and depositing the container ends at said first loading area and in said first tray to form a first load and for engaging container ends from the second source at said pick-up area and depositing the container ends at said second loading area and in said second tray to form a second load, wherein container ends from said first source are only deposited at said first loading area, and wherein container ends from said second source are only deposited at said second loading area, said moving means comprising a common pick-up head which interfaces with container ends from each of said first and second sources and moves said container ends to said first and second loading areas, respectively.

2. An assembly, as claimed in claim 1, further comprising:

a first supply means for receiving an array of container ends from the first source, separating the container ends into sticks, and providing the sticks to said pick-up area; and a second supply means for receiving an array of container ends from the second source, separating the container ends into sticks, and providing the sticks to said pick-up area.

3. An assembly, as claimed in claim 2, wherein said first and second supply means each comprise separator means for separating a stick of container ends from the respective array of ends, wherein each of said separator means positions a stick of container ends from a separating area to a staging area, said staging area being between said separating area and said pick-up area.

4. An assembly, as claimed in claim 3, wherein said first and second supply means each further comprise shuttle means for transporting a stick of container ends from said staging area to said pick-up area.

5. An assembly, as claimed in claim 4, wherein said first and second supply means each further comprise:

control means for selectively activating and deactivating the respective first and second sources;

a pick-up sensor, operatively connected to said control means, for sensing the presence of a stick of container ends in said pick-up area;

a staging sensor, operatively connected to said control means, for sensing the presence of a stick of container ends in said staging area; and a separating sensor, operatively connected to said control means, for sensing the presence of a stick of container ends in said separating area, wherein said control means deactivates the respective source if each of said respective sensors indicate that a stick of container ends is present in each of said respective areas.

6. An assembly, as claimed in claim 2, wherein said moving means deposits sticks of container ends into channels of trays positioned at said first and second loading areas.

7. An assembly, as claimed in claim 6, wherein said trays are stackable.

8. An assembly, as claimed in claim 7, further comprising a tray supply area for accommodating a stack of empty trays, wherein said moving means includes engaging means for selectively engaging and disengaging an empty tray at said tray supply area, whereby an empty tray may be engaged at said tray supply area, moved to at least one of said first and second loading areas, and deposited in stacked relation over a full tray at said loading area.

9. An assembly, as claimed in claim 2, wherein said first and second supply means each comprise trough means for directing sticks of container ends toward said pick-up area.

10. An assembly, as claimed in claim 9, wherein each of said trough means is at least partially inclined.

11. An assembly, as claimed in claim 1, wherein said moving means comprises:

a transfer mechanism, operatively connected to said pick-up head, for selectively moving said pick-up head between said pick-up area, said first loading area, and said second loading area.

12. An assembly, as claimed in claim 11, wherein said pick-up head comprises axial compression means for selectively providing axial compression to opposing ends of a stick of container ends.

13. An assembly, as claimed in claim 12, wherein said axial compression means comprises at least two compression clamps mounted on opposing end portions of said pick-up head and movable between a compressed condition and a released condition.

14. An assembly, as claimed in claim 13, wherein said axial compression means comprises six compression members appropriately mounted on opposing end portions of said pick-up head to provide axial compression to three sticks of container ends.

15. An assembly, as claimed in claim 11, wherein said transfer mechanism includes means for selectively tilting said pick-up head.

16. An assembly, as claimed in claim 15, wherein said means for selectively tilting said pick-up head comprises a rotary actuator.

17. An assembly, as claimed in claim 1, further comprising:

a first discharge means for transporting the first load from said first loading area to a first discharge area; and a second discharge means for transporting the second load from said second loading area to a second discharge area.

18. An assembly, as claimed in claim 17, wherein said first and second discharge means each comprise a conveyor means connecting each of said loading areas with said respective discharge area.

19. An assembly, as claimed in claim 18, wherein each of said conveyor means comprises at least one powered conveyor.

20. An assembly, as claimed in claim 17, wherein said first and second discharge means each comprise:

a buffer area, between said loading area and said discharge area, for temporarily accommodating a load of container ends;

control means for selectively activating and deactivating said moving means;

a buffer sensor, operatively connected to said control means, for sensing the presence of a load of container ends in said buffer area; and a discharge sensor, operatively connected to said control means, for sensing the presence of a load of container ends in said discharge area, wherein said control means deactivates said moving means if all of said respective sensors indicate that a load of container ends is present in each of said respective areas.

21. An apparatus as claimed in claim 1, wherein said moving means is disposed between said first and second loading areas.

22. An apparatus as claimed in claim 21, wherein said moving means is interposed between said first loading area and said second loading area.

23. An assembly, as claimed in claim 1, wherein said pick-up area comprises:

a first pick-up area for receiving a plurality of container ends from the first source; and a second pick-up area, separate from said first pick-up area, for receiving a plurality of container ends from the second source different from the first source.

24. An apparatus as claimed in claim 1, wherein container ends from the first source have a configuration different than container ends from the second source.

25. An apparatus as claimed in claim 1, wherein said first and second loading areas are located distal said pick-up area.

26. An apparatus as claimed in claim 1, wherein said moving means moves container ends from the first source in a first direction towards said first loading area to form said first load and moves container ends from the second source in a second direction, different than said first direction, towards said second loading area to form said second load.

27. A method for processing container ends received from at least two sources utilizing a transport device comprising a pick-up head, said method comprising the steps of:

receiving a first stick of container ends at a pick-up area from a first source;

receiving a second stick of container ends at the pick-up area from a second source, different from the first source;

engaging the first stick at the pick-up area with the pick-up head of the transport device, moving the transport device to a first position, and depositing the first stick at a first loading area to form a first load; and engaging the second stack at the pick-up area with the pick-up head of the transport device, moving the transport device to a second position different from the first position, and depositing the second stick at the second loading area to form a second load, wherein sticks from the first source are only deposited at the first loading area, and wherein sticks from the second source are only deposited at the second loading area.

28. A method, as claimed in claim 27, wherein the engaged sticks are deposited into trays at the first and second loading areas during said steps of engaging the first and second stick, respectively, and wherein, when a tray in a loading area is completely filled, said method further comprises the steps of:

engaging an empty tray at a tray supply area;

transporting the empty tray to the loading area corresponding with the completely filled tray, and stacking the empty tray onto the completely filled tray.

29. A method, as claimed in claim 28, wherein the recited steps are sequentially performed until a desired stack of trays is developed.

30. A method, as claimed in claim 27, wherein said steps of receiving a first stick and receiving a second stick comprise the steps of:

receiving a first array of container ends from the first source, separating the first array into the first stick, and providing the first stick to the pick-up area; and receiving a second array of container ends from the second source, separating the second array into the second stick, and providing the second stick to the pick-up area.

31. A method, as claimed in claim 27, further comprising the steps of:

transporting the first load from the first loading area to a first discharge area; and transporting the second load from the second loading area to a second discharge area.

32. A method, as claimed in claim 27, wherein the first loading area is separate from the second loading area such that each loading area can support a separate tray for accommodating a stick therein.

33. A method as claimed in claim 27, further comprising the steps of:

selecting one of said first and second sticks for transport from the pick-up area for deposit in a corresponding loading area, the corresponding loading area being the first loading area where the first stick is selected, and the second loading area where the second stick is selected; and moving the selected stick towards the corresponding loading area.

34. A method as claimed in claim 27, wherein:

the second loading area is open to receive sticks from the second source while sticks from the first source are being deposited at the first loading area.

35. A method as claimed in claim 27, further comprising the step of:

identifying equipment which processed a particular container end solely by determining whether said particular container end was from said first loading area or said second loading area.

* * * * *